US009606472B2

(12) United States Patent
Fujii et al.

(10) Patent No.: US 9,606,472 B2
(45) Date of Patent: Mar. 28, 2017

(54) IMAGE FORMING APPARATUS HAVING LIGHT EMISSION LUMINANCE BASED ON SCANNING SPEED

(71) Applicant: CANON KABUSHIKI KAISHA, Tokyo (JP)

(72) Inventors: Kenichi Fujii, Suntou-gun (JP); Hidenori Kanazawa, Mishima (JP); Takashi Kawana, Machida (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/044,935

(22) Filed: Feb. 16, 2016

(65) Prior Publication Data

US 2016/0246210 A1 Aug. 25, 2016

(30) Foreign Application Priority Data

Feb. 19, 2015 (JP) ..... 2015-031051

(51) Int. Cl.
*G03G 15/04* (2006.01)
*G03G 15/043* (2006.01)

(52) U.S. Cl.
CPC ..... *G03G 15/043* (2013.01)

(58) Field of Classification Search
CPC ..... G03G 15/043
USPC ..... 399/4, 51; 347/247, 252, 253, 254
See application file for complete search history.

(56) References Cited

U.S. PATENT DOCUMENTS

2015/0251442 A1* 9/2015 Ishida ..... B41J 2/471 347/247

FOREIGN PATENT DOCUMENTS

| | | | |
|---|---|---|---|
| JP | 58-125064 A | | 7/1983 |
| JP | 62-032768 A | | 2/1987 |
| JP | 8-171260 A | | 7/1996 |
| JP | 2004-098590 A | | 4/2004 |
| JP | 2009216744 A | * | 9/2009 |
| JP | 2012-189886 A | | 10/2012 |
| JP | 2014-013374 A | | 1/2014 |

* cited by examiner

*Primary Examiner* — Sophia S Chen
(74) *Attorney, Agent, or Firm* — Canon USA, Inc. IP Division

(57) ABSTRACT

A pixel distance corrector configured to correct a pixel distance in the main scanning direction so that latent images corresponding to each pixel of image data are formed on the surface of the photosensitive member at substantially equal intervals in the main scanning direction. A controller configured to control a light source to emit light with a first light emission luminance with respect to an image part of the photosensitive member, and a second light emission luminance which is lower than the first light emission luminance, with respect to a non-image part of the photosensitive member. The controller is configured to correct light emission luminance so that the second light emission luminance decreases as the scanning speed decreases.

14 Claims, 26 Drawing Sheets

FIG.17A

BD SIGNAL

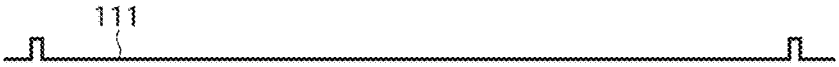

FIG.17B

PARTIAL MAGNIFICATION CHARACTERISTIC INFORMATION (%)

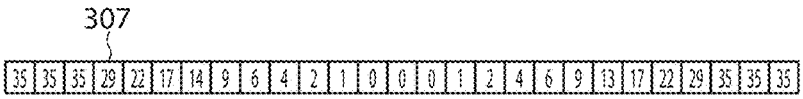

FIG.17C

PARTIAL MAGNIFICATION CORRECTION INFORMATION

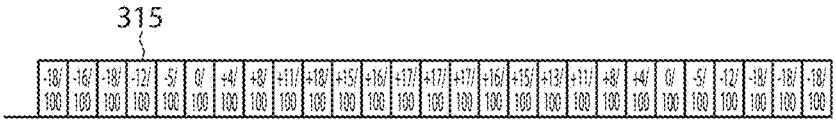

FIG.17D

VDO SIGNAL

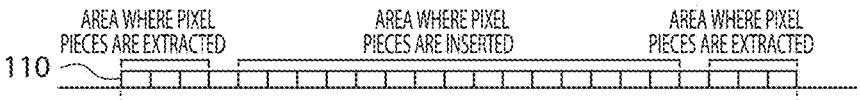

FIG.17E

LUMINANCE (LASER LIGHT AMOUNT AT DENSITY OF 100%)

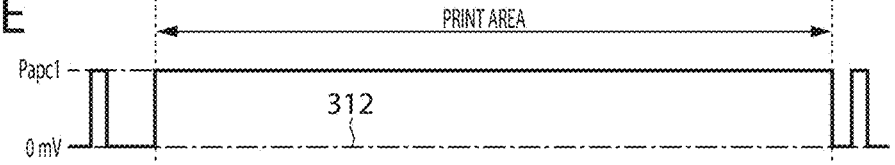

FIG.17F

IMAGE DENSITY VALUE AFTER GRADATION CORRECTION

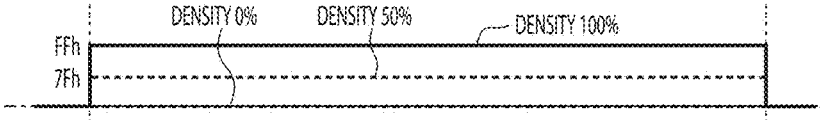

FIG.17G

IMAGE DENSITY VALUE AFTER NON-IMAGE PART WEAK EXPOSURE CORRECTION

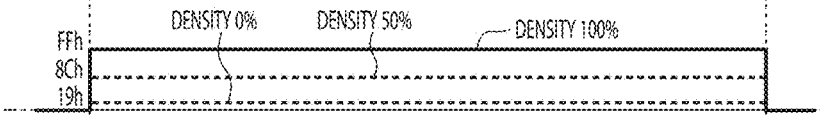

FIG.17H

IMAGE DENSITY VALUE AFTER f θ CORRECTION

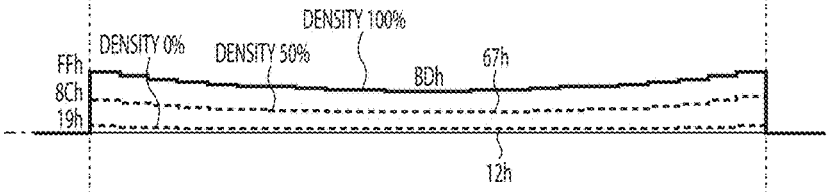

FIG.17I

LASER LIGHT AMOUNT

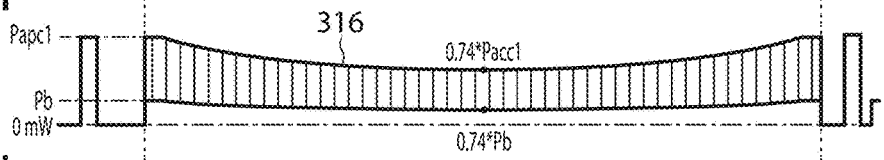

FIG.17J

TOTAL AMOUNT OF EXPOSURE AT SURFACE OF PHOTOSENSITIVE DRUM 4

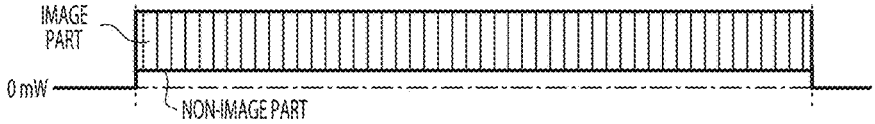

IMAGE FORMING APPARATUS HAVING LIGHT EMISSION LUMINANCE BASED ON SCANNING SPEED

BACKGROUND OF THE INVENTION

Field of the Invention

One disclosed aspect of the embodiments relates to an image forming apparatus that performs optical writing by using a laser beam, such as a laser beam printer (LBP), a digital copying machine, and a digital facsimile (FAX).

Description of the Related Art

An electrophotographic image forming apparatus includes an optical scanning unit, or scanner, for exposing a photosensitive member. The optical scanner emits laser light based on image data, reflects the laser light with a rotating polygonal mirror, and passes the laser light through a scanning lens to irradiate and expose the photosensitive member. The rotating polygonal mirror is rotated to move a spot of the laser light formed on a surface of the photosensitive member for the purpose of scanning, thereby forming a latent image on the photosensitive member.

The scanning lens is a lens having an fθ characteristic. The fθ characteristic refers to an optical characteristic of the lens in forming a laser light image on the surface of the photosensitive member to move over the surface of the photosensitive member at a constant speed when the rotating polygonal mirror is rotating at a constant angular speed. By using the scanning lens having the fθ characteristic appropriate exposure can be achieved.

The scanning lens having such an fθ characteristic comes in a relatively large size and is costly. For the purpose of miniaturization and cost reduction of the image forming apparatus, disuse of the scanning lens itself or use of a scanning lens having no fθ characteristic has been contemplated.

Japanese Patent Application Laid-Open No. 58-125064 discusses an electrical correction method for changing an image clock frequency during a scan so that even if the spot of the laser light on the surface of the photosensitive member does not move over the surface of the photosensitive member at a constant speed, dots having a constant width are formed on the surface of the photosensitive member.

In order to suppress image defects due to uneven charging, Japanese Patent Application Laid-Open No. 8-171260 discusses an image forming apparatus that not only exposes an image part where toner adheres to, but also performs post-exposure on a non-image part where toner does not adhere to. Japanese Patent Application Laid-Open No. 2012-189886 discusses an image forming apparatus that includes a plurality of image forming stations and forms a color image, wherein the image forming stations use a common charging voltage and developing voltage. Japanese Patent Application Laid-Open No. 2012-189886 discusses performing exposure on a non-image part with a small amount of light to maintain an appropriate non-image part potential if photosensitive drums of the respective image forming stations have different film thicknesses.

However, it is not clear how to perform the weak exposure on a non-image part as discussed in Japanese Patent Application Laid-Open Nos. 8-171260 and 2012-189886 with a configuration not using a scanning lens having an fθ characteristic.

SUMMARY OF THE INVENTION

According to an aspect of the embodiments, an image forming apparatus including a photosensitive member, irradiated based on image data by a light source configured to emit laser light, and a deflector configured to deflect the laser light so that the laser light moves over a surface of the photosensitive member in a main scanning direction, wherein a scanning speed at which the laser light moves over the surface of the photosensitive member in the main scanning direction, is not constant, includes a pixel distance correction unit, or a pixel distance corrector, configured to correct a pixel distance in the main scanning direction so that latent images corresponding to each pixel of the image data are formed on the surface of the photosensitive member at substantially equal intervals in the main scanning direction, and a control unit, or controller configured to control the light source to emit the laser light with a first light emission luminance with respect to an image part of the photosensitive member and a second light emission luminance which is lower than the first light emission luminance, with respect to a non-image part of the photosensitive member, wherein the controller is configured to correct light emission luminance so that the second light emission luminance decreases as the scanning speed decreases.

Further features of the disclosure will become apparent from the following description of exemplary embodiments with reference to the attached drawings.

12B is a graph illustrating a characteristic of the current and luminance of the light emission unit during weak exposure.

Figure 13:
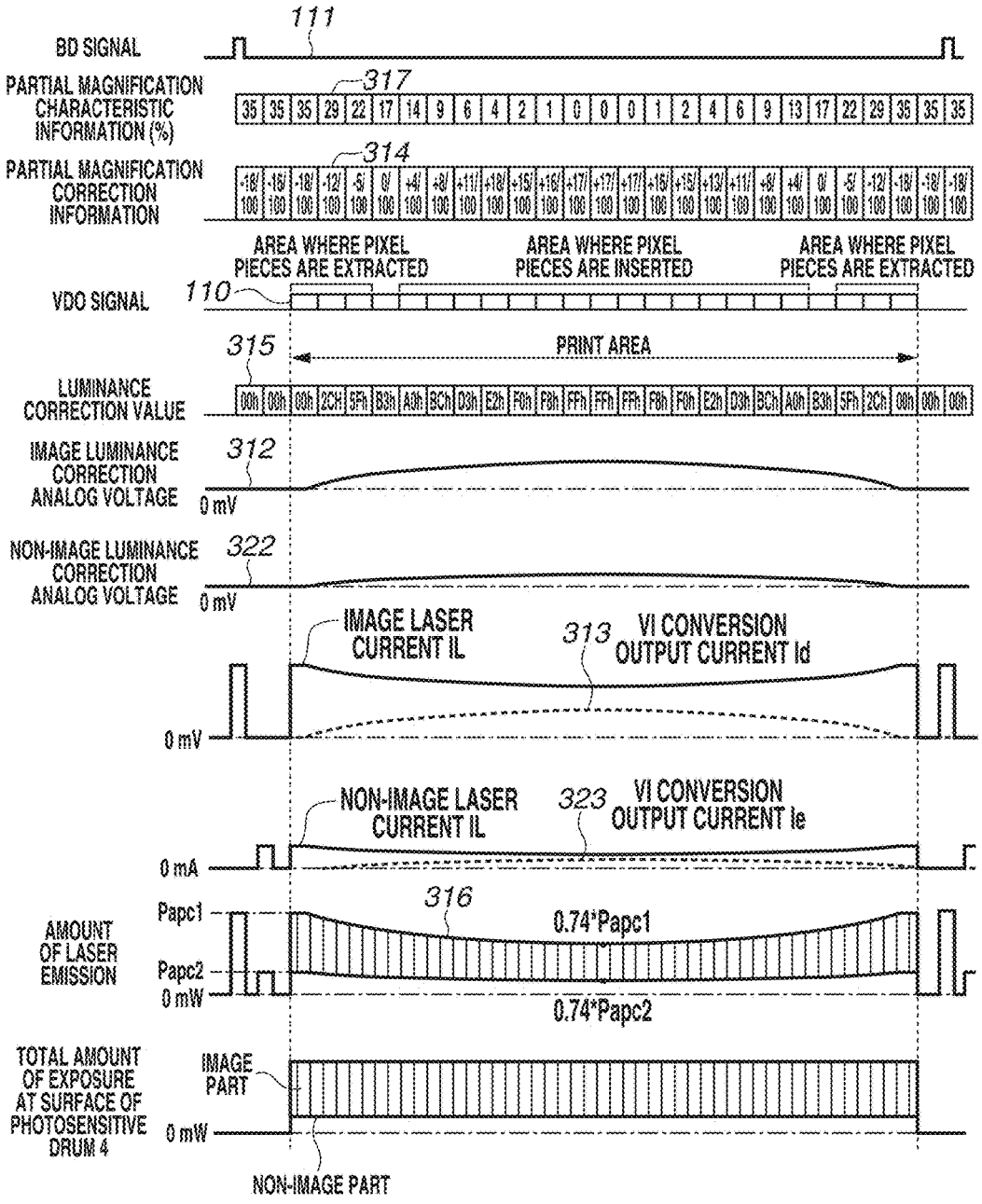

FIG. 13 is a timing chart for describing partial magnification correction and luminance correction.

Figure 14:
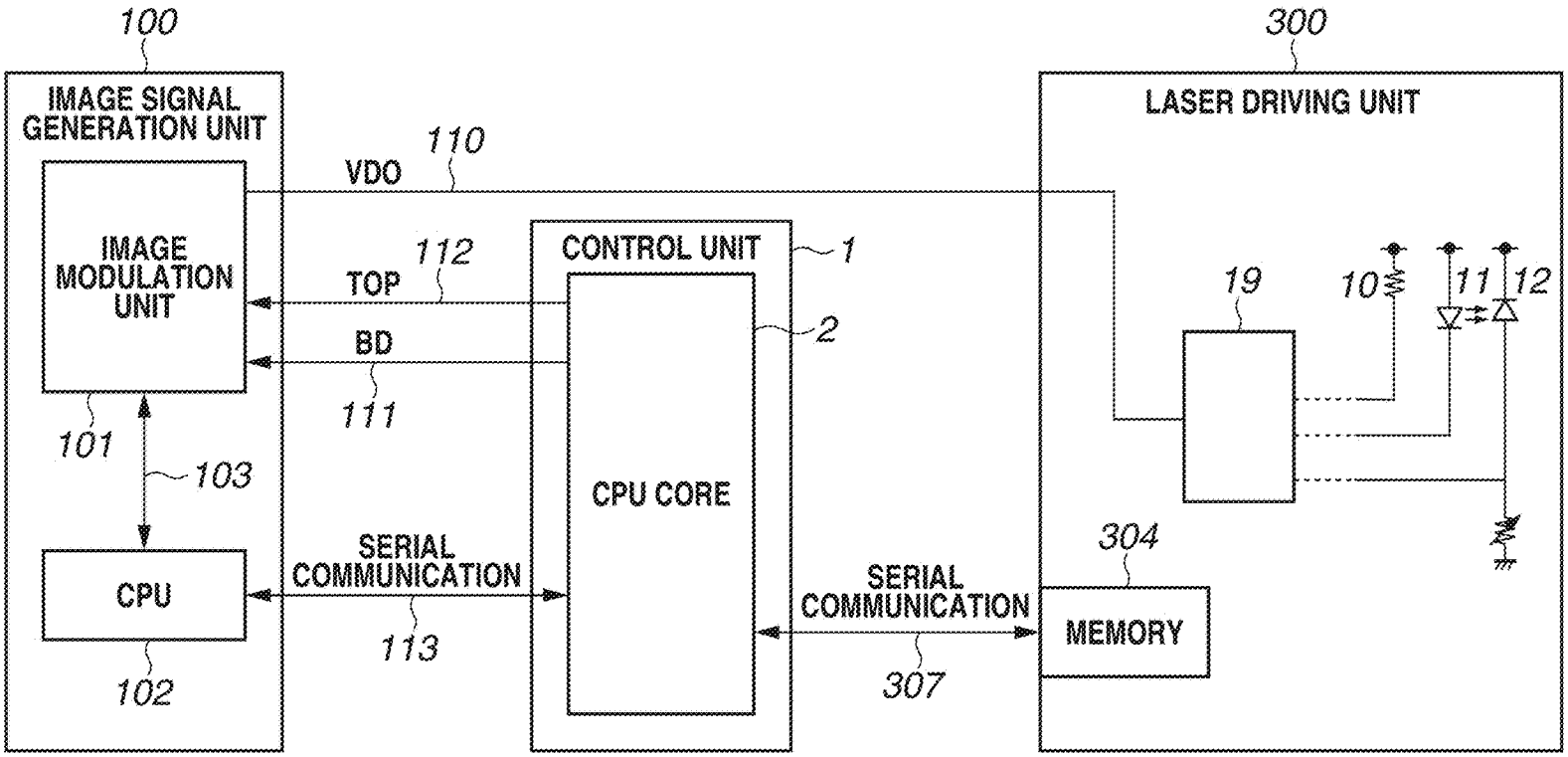

FIG. 14 is an electrical block diagram for illustrating an exposure control configuration according to a second exemplary embodiment.

Figure 15A:
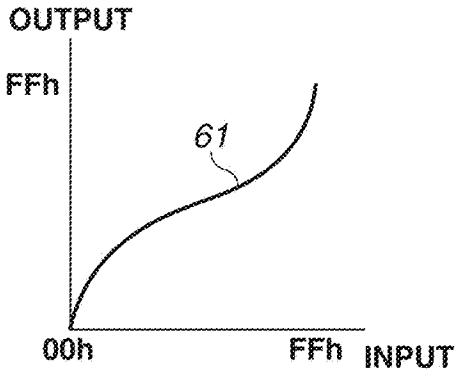
Figure 15B:
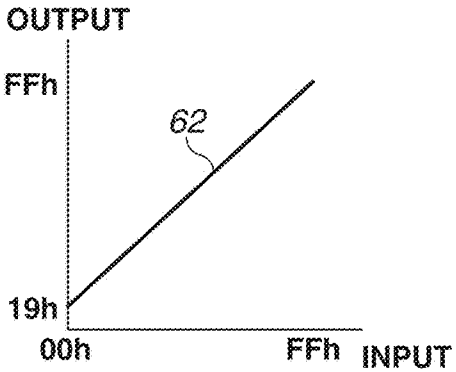
Figure 15C:
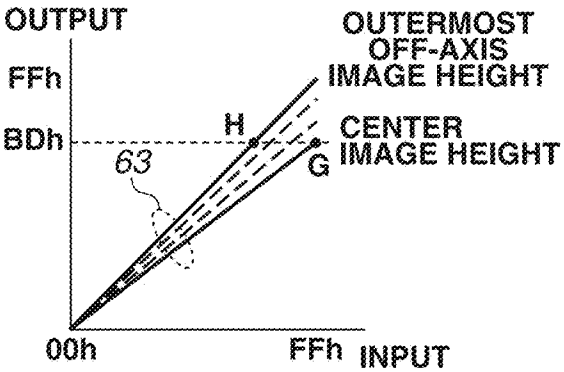
Figure 15D:
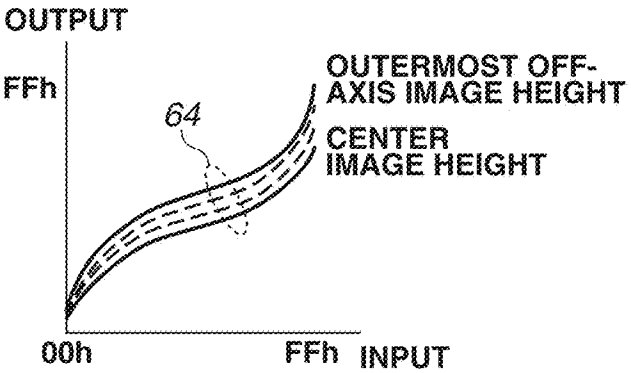

FIG. 15A is a density correction graph for gradation correction. FIG. 15B is a density correction function graph for performing weak exposure on a non-image part. FIG. 15C is a density correction function graph for fθ correction. FIG. 15D is a density correction function graph according to the second exemplary embodiment.

Figure 16A:
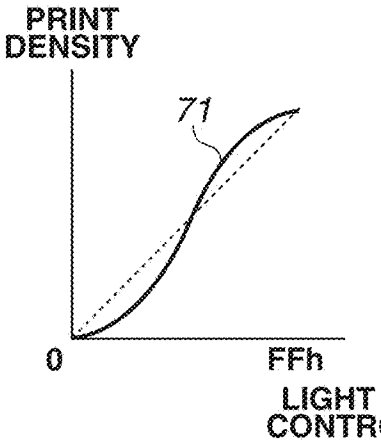
Figure 16B:
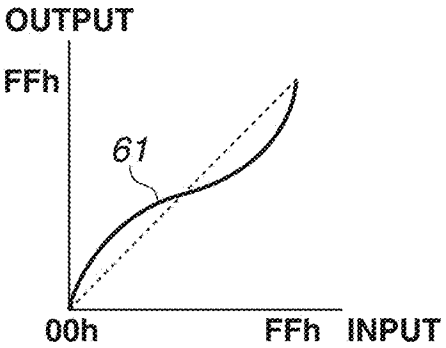
Figure 16C:
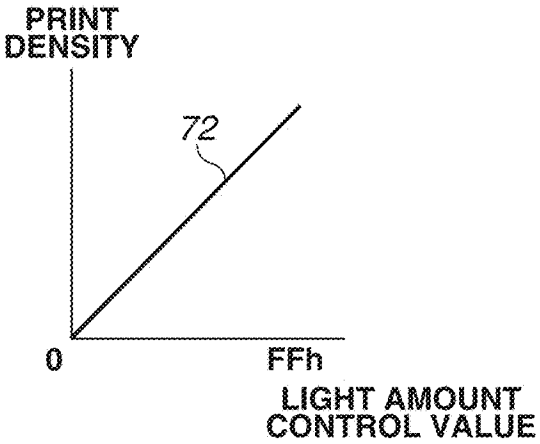

FIG. 16A is a gradation curve before gradation correction. FIG. 16B is a density correction graph for gradation correction. FIG. 16C is a gradation curve after the gradation correction.

FIGS. 17A, 17B, 17C, 17D, 17E, 17F, 17G, 17H, 17I, and 17J illustrate a timing chart for describing partial magnification correction and density correction according to the second exemplary embodiment.

Figure 18A:
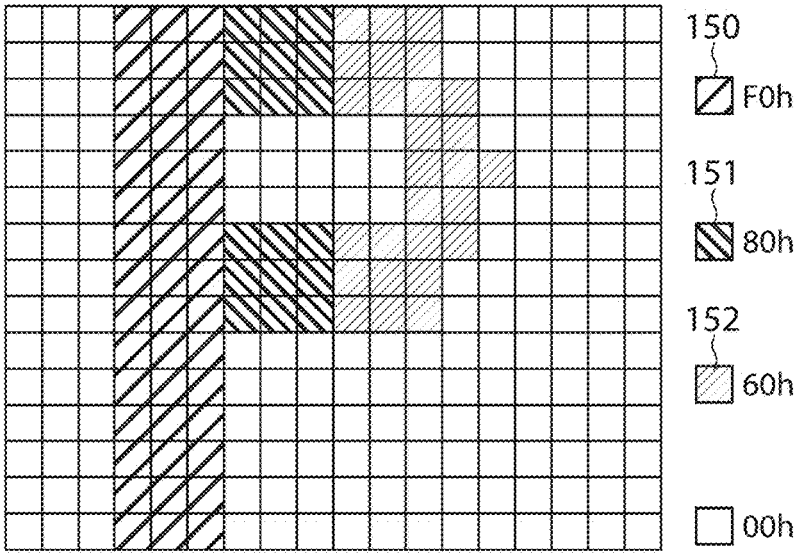
Figure 18B:
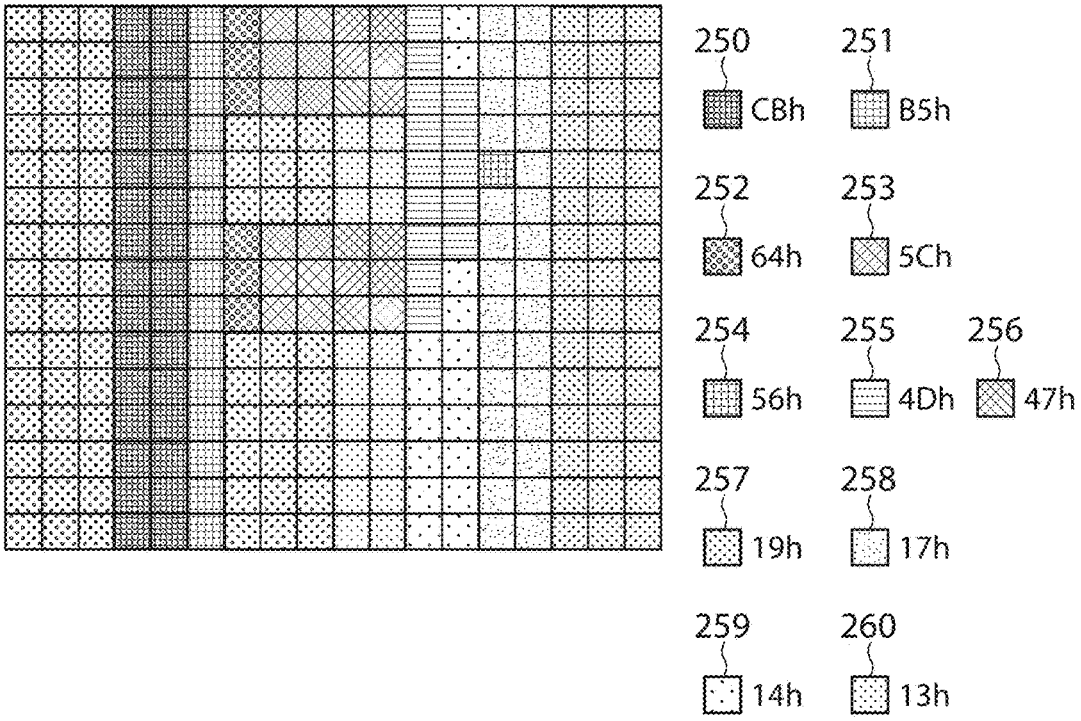

FIG. 18A is a diagram illustrating an example of an image signal input to a density correction processing unit according to the second exemplary embodiment. FIG. 18B is a diagram illustrating an example of the image signal after the density correction according to the second exemplary embodiment.

Figure 19:
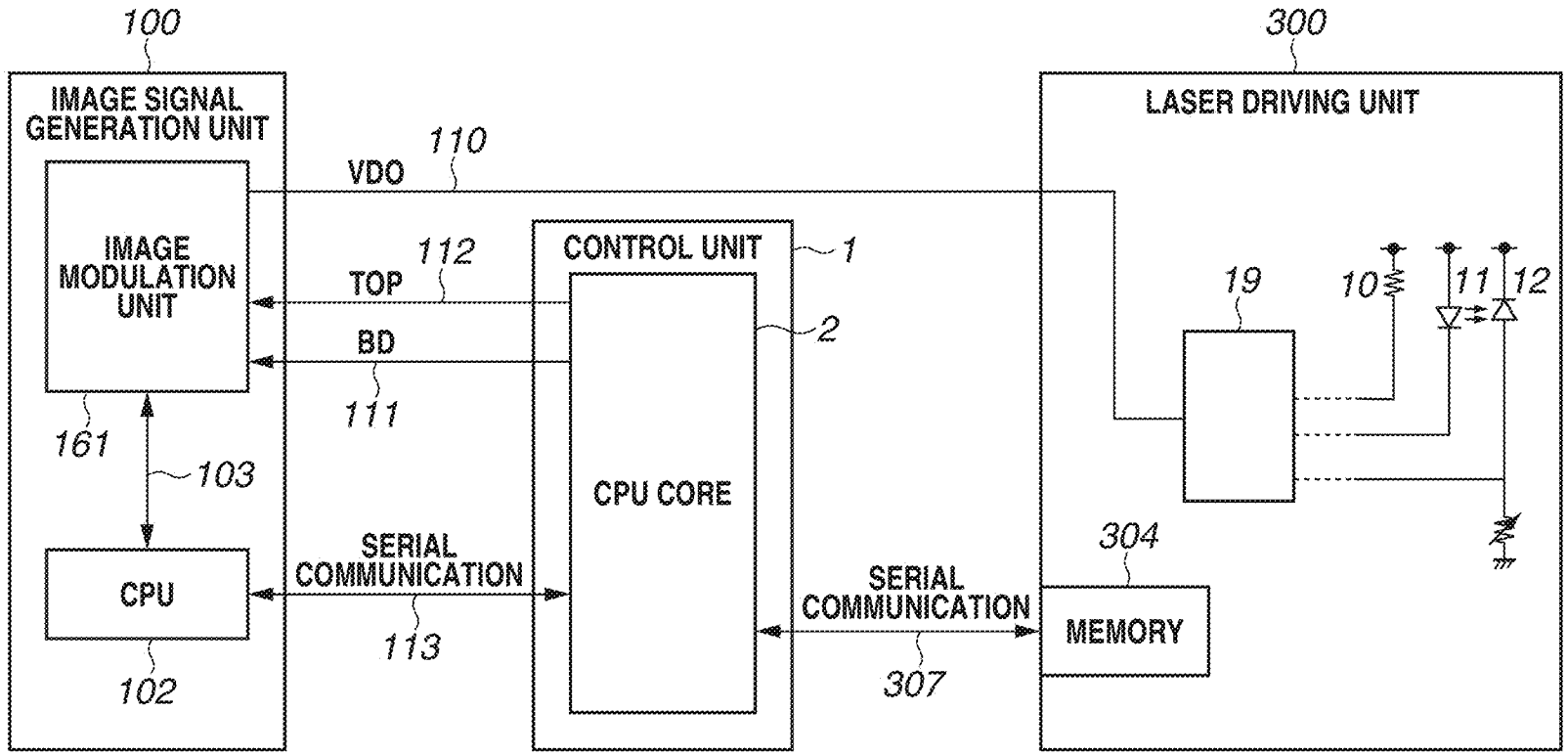

FIG. 19 is a block diagram illustrating an exposure control configuration according to a third exemplary embodiment.

Figure 20:
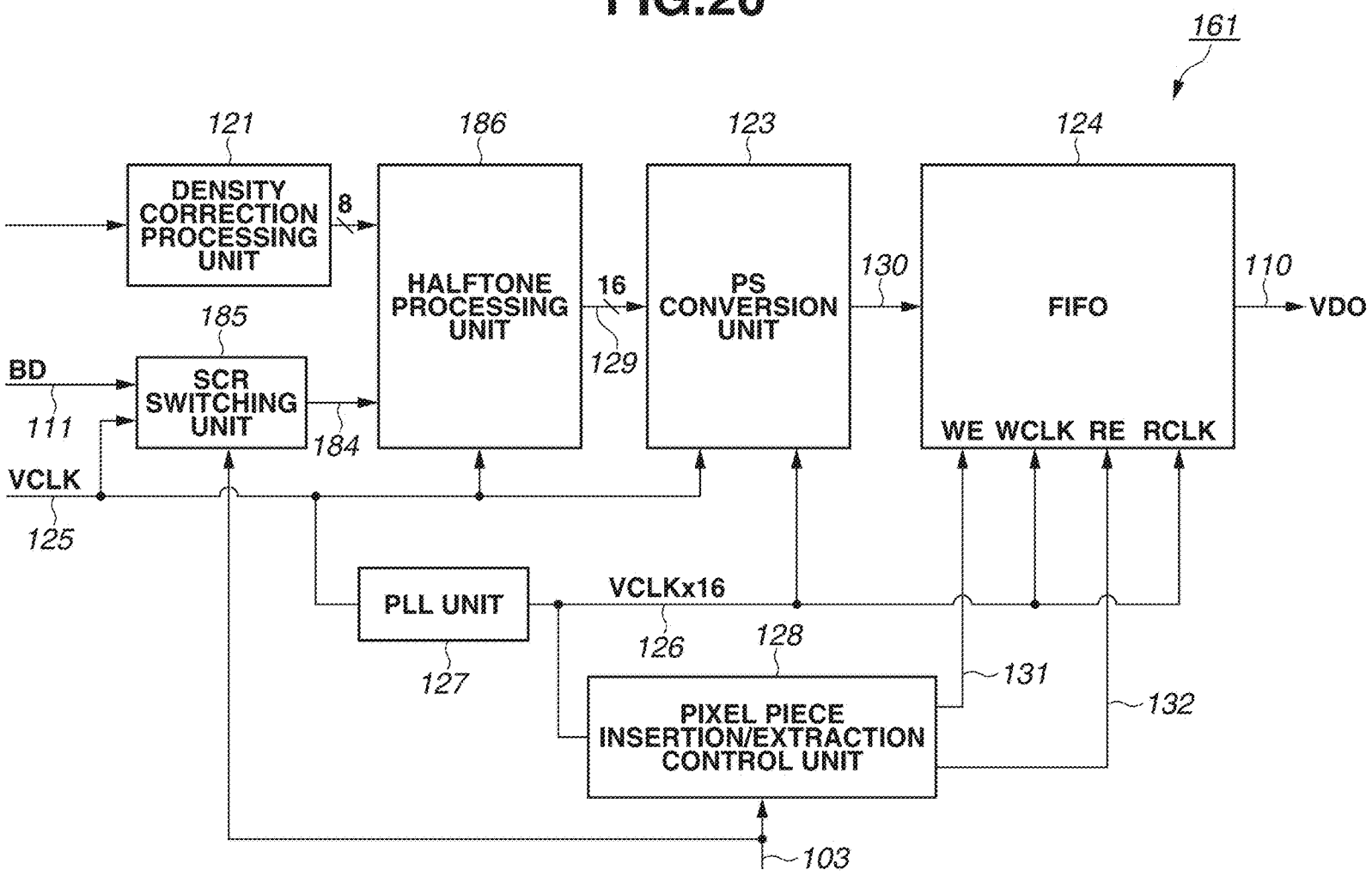

FIG. 20 is a block diagram illustrating an image modulation unit according to the third exemplary embodiment.

Figure 21:
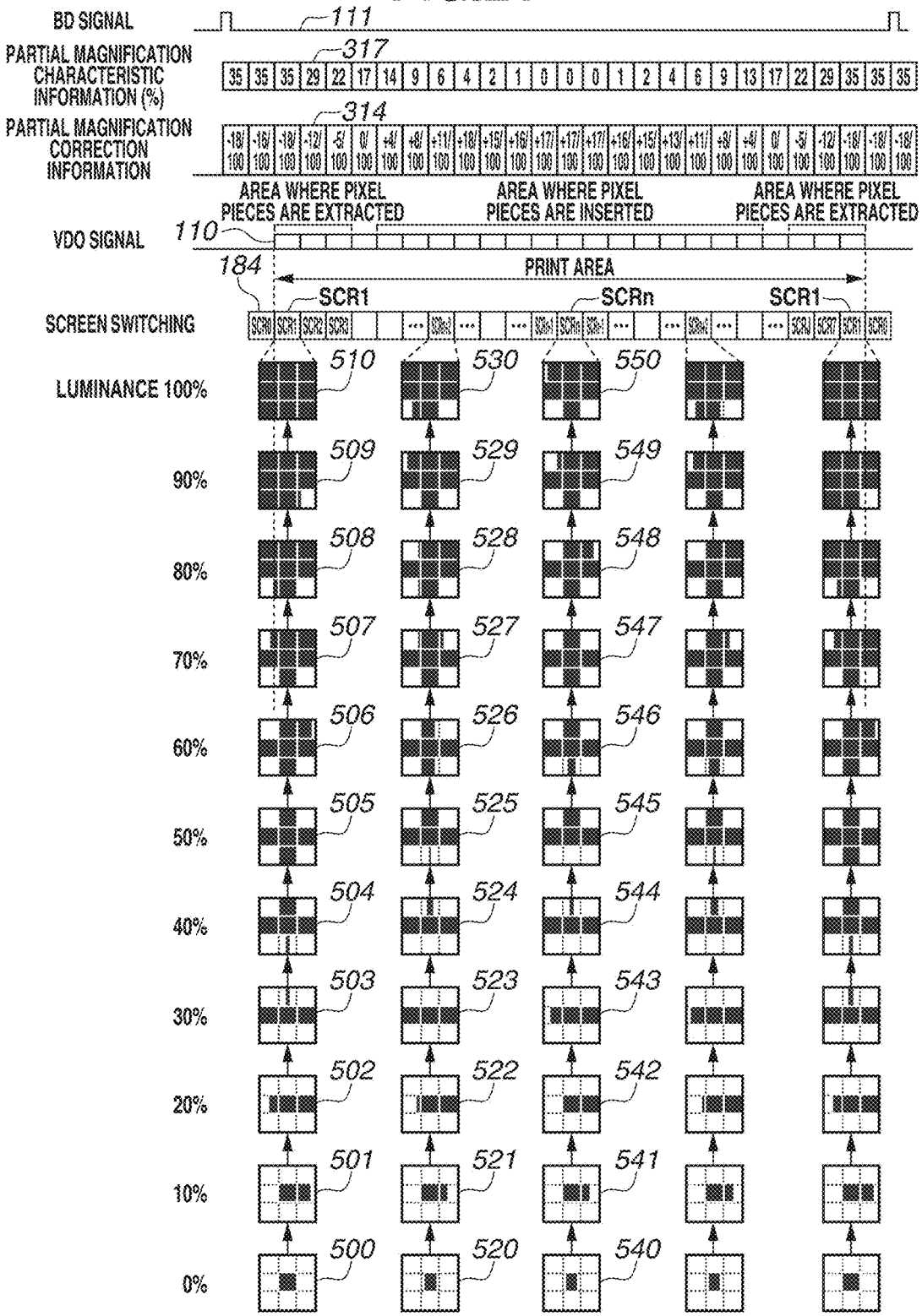

FIG. 21 is a diagram illustrating a timing chart of a synchronization signal, screen switching information, and an image signal, and an example of screens.

Figure 22:
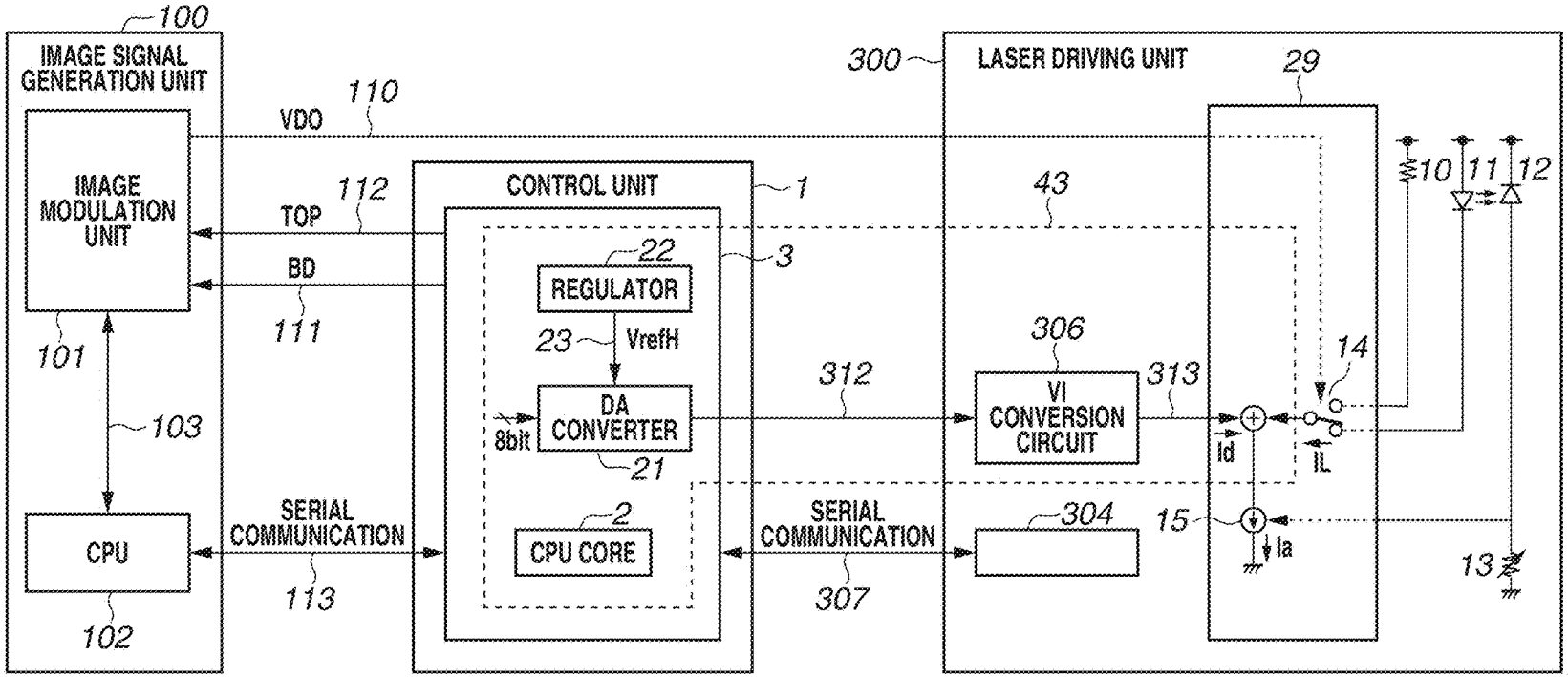

FIG. 22 is a block diagram illustrating an exposure control configuration according to a fourth exemplary embodiment.

Figure 23:
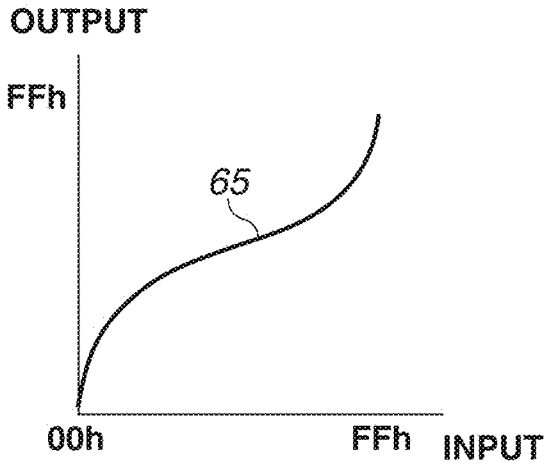

FIG. 23 is a density correction function graph according to the fourth exemplary embodiment.

FIGS. 24A, 24B, 24C, 24D, 24E, 24F, 24G, 24H, and 24I illustrate a timing chart for describing partial magnification correction, luminance correction, and density correction according to the fourth exemplary embodiment.

Figure 25A:
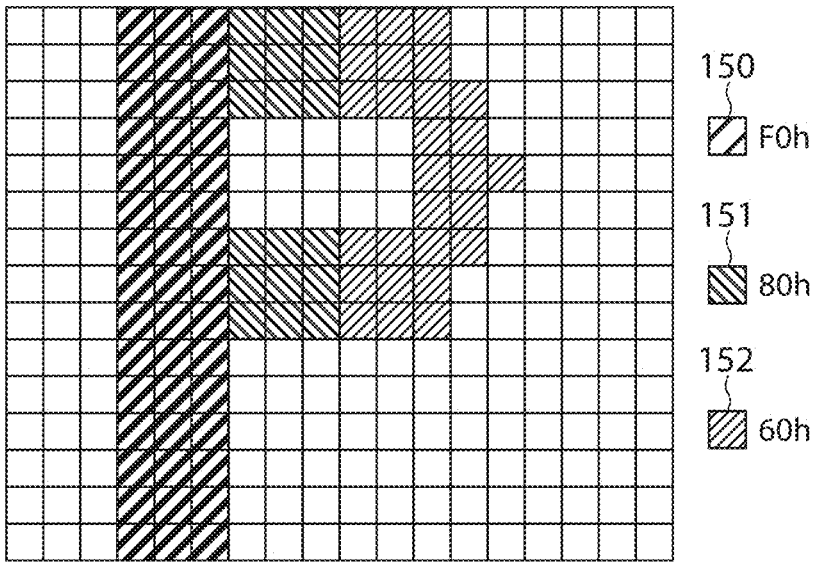
Figure 25B:
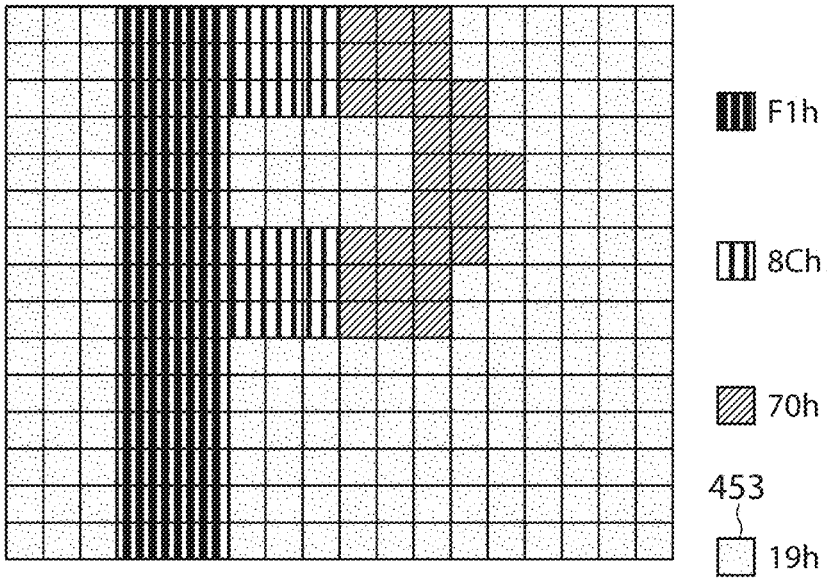

FIG. 25A is a diagram illustrating an example of an image signal input to a density correction processing unit according to the fourth exemplary embodiment. FIG. 25B is a diagram illustrating an example of the image signal after the density correction according to the fourth exemplary embodiment.

DESCRIPTION OF THE EMBODIMENTS

Image Forming Apparatus

Figure 1A:
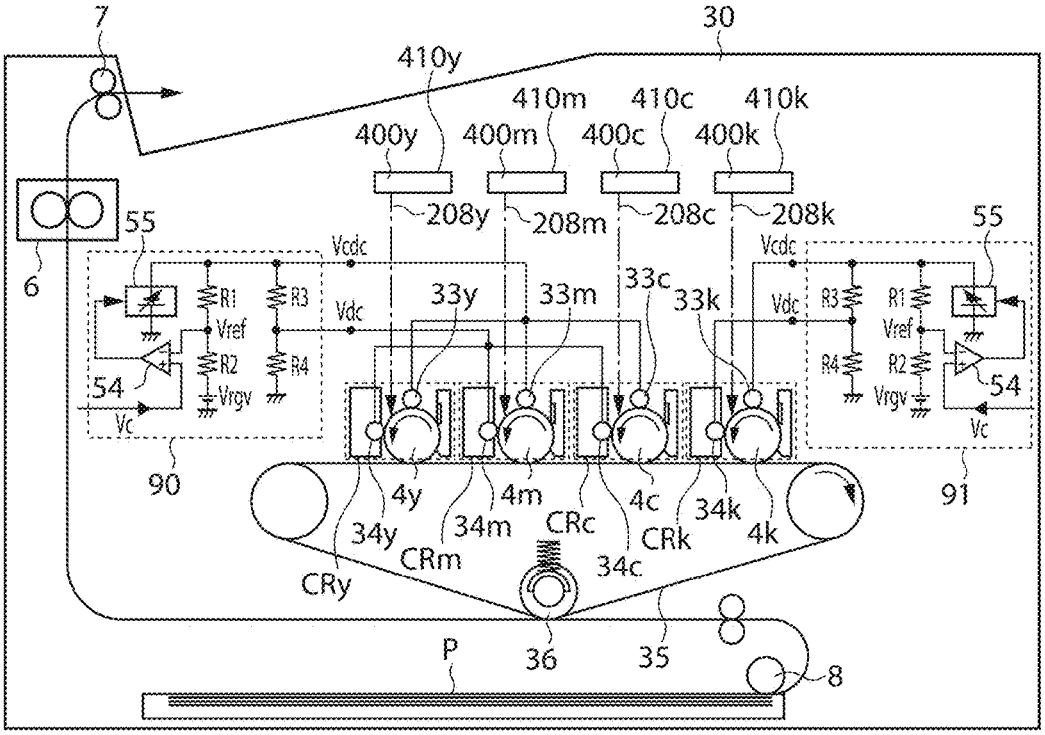
FIG. 1A is a schematic configuration diagram of an image forming apparatus.
Figure 1B:
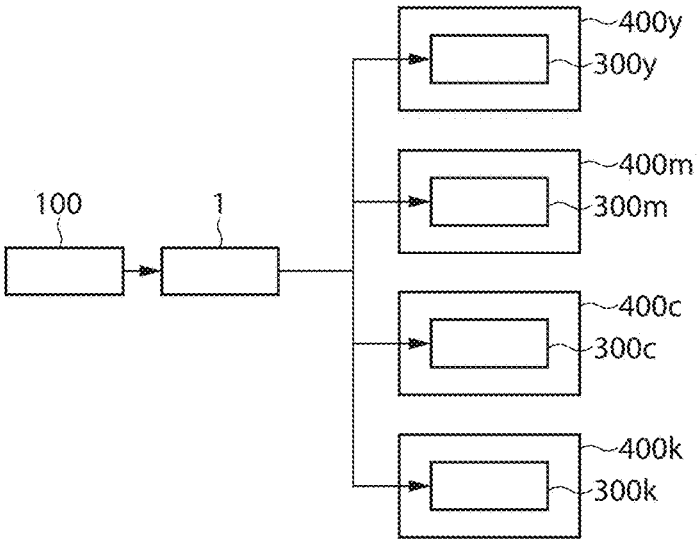
FIG. 1B is a block diagram illustrating a control configuration of optical scanning units or scanners.

A first exemplary embodiment will be described below. FIG. 1A is a diagram illustrating a schematic cross section of an image forming apparatus 30. FIG. 1B is a block diagram illustrating a control configuration of optical scanning units, or scanners, 400. The image forming apparatus 30 includes first to fourth (y, m, c, and k) image forming stations. The first image forming station is a yellow (hereinafter, referred to as y) image forming station. The second image forming station is a magenta (hereinafter, referred to as m) image forming station. The third image forming station is a cyan (hereinafter, referred to as c) image forming station. The fourth image forming station is a black (hereinafter, referred to as k) image forming station. The image forming stations y, m, c, and k include storage members (memory tags) storing the cumulative number of rotations of respective photosensitive drums 4 as information about the life of the photosensitive drums 4. The image forming stations each include a cartridge CR. First to fourth cartridges CR (CRy, CRm, CRc, and CRk) can be detachably attached to a main body unit of the image forming apparatus 30 for replacement. While each cartridge CR is described to be one in which the corresponding photosensitive drum 4, a charging unit, or charger, 33, and a developing unit, or developer, 34 are integrated, the cartridge CR has only to include at least the photosensitive drum 4.

Each image forming station has similar configurations and performs similar operations for image formation. In the following description, with the first image forming station including the yellow photosensitive drum 4*y* as a representative, an operation of image formation on a recording medium P, mainly regarding that of the first image forming station, will thus be described. Configurations common to magenta, cyan, and black may be described with parenthesized reference numerals. Similar members or units provided corresponding to the respective image forming stations, like "photosensitive drums 4*y*, 4*m*, 4*c*, and 4*k*," may be denoted and described like "photosensitive drums 4." That is, the notation of the reference numerals "4*y*," "4*m*," "4*c*," and "4*k*" representing the respective members or units may be abbreviated so that the members or units are described with the reference numeral "4" without attaching "y," "m," "c," and "k" denoting the corresponding image forming stations.

The image forming stations include the photosensitive drums 4 (4*y*, 4*m*, 4*c*, and 4*k*) as photosensitive members. The photosensitive drum 4*y* is driven to rotate in the direction of the arrow at a predetermined circumferential speed (process speed). In the course of the rotation process, the photosensitive drum 4*y* is uniformly charged to a charging potential of predetermined polarity by a charging roller 33 (33*y*, 33*m*, 33*c*, and 33*k*). A surface of the photosensitive drum 4*y* corresponding to an image part is then exposed for electric neutralization by scanning with scanning light 208 (208*y*, 208*m*, 208*c*, and 208*k*) from an optical scanning unit 400 (400*y*, 400*m*, 400*c*, and 400*k*) based on image data supplied from outside. An exposure potential his thereby formed on the surface of the photosensitive drum 4*y*.

As illustrated in FIG. 1B, the optical scanning units 400 (400*y*, 400*m*, 400*c*, and 400*k*) include respective laser driving units 300 (300*y*, 300*m*, 300*c*, and 300*k*). The optical scanning unit 400*y* emits the scanning light 208*y* (hereinafter, also referred to as laser light 208*y*) based on a signal (VDO signal) that is output based on the image data, received from an image signal generation unit 100, and a control signal that is output from a control unit 1.

Toner is developed and visualized on the portion of the exposure potential, which is the image part, by a potential difference between a developing voltage Vdc applied to a first developing unit (yellow developing device) 34 (34*y*, 34*m*, 34*c*, and 34*k*) and the exposure potential. The image forming apparatus 30 according to the present exemplary embodiment is an apparatus employing reversal development method in which the optical scanning unit 400*y* performs image exposure and the exposed portion is developed with toner.

An intermediate transfer belt 35 is stretched across a plurality of rollers and put in contact with the photosensitive drums 4 (4*y*, 4*m*, 4*c*, and 4*k*). The intermediate transfer belt 35 is driven to rotate in the same direction and at approximately the same circumferential speed as the photosensitive drum 4*y* in the contact position. A yellow toner image formed on the photosensitive drum 4*y* passes through a contact portion (hereinafter, referred to as a first transfer nip)

between the photosensitive drum 4*y* and the intermediate transfer belt 35. In the process of passing through the first transfer nip, the yellow toner image is transferred onto the intermediate transfer belt 35 (primary transfer) by a primary transfer voltage supplied to a not-illustrated primary transfer unit. Primary transfer residual toner remaining on the surface of the photosensitive drum 4*y* is cleaned and removed by a not-illustrated cleaning unit and subsequently image forming processes from the charging process described above are repeated.

Subsequently, a second-color magenta toner image, a third-color cyan toner image, and a fourth-color black toner image are similarly formed in the other image forming stations. The toner images are successively transferred onto the intermediate transfer belt 35 in an overlaying manner to obtain a color image.

The four color toner images on the intermediate transfer belt 35 pass through a contact portion (hereinafter, referred to as a secondary transfer nip) between the intermediate transfer belt 35 and a secondary transfer roller 36. In the process of passing through the secondary transfer nip, the four color toner images are simultaneously transferred onto a surface of a recording medium P, which is fed by a feed roller 8 serving as a feed unit, while applying a secondary transfer voltage supplied to a not-illustrated secondary transfer unit. The recording medium P bearing the four color toner images is then conveyed to a fixing device 6. In the fixing device 6, the four color toner images are heated and pressed to melt and mix the four color toners, and thereby fixed to the recording medium P. Through such an operation, a full-color toner image is formed on the recording medium P. The recording medium P is then discharged to the outside of the image forming apparatus 30 by a discharge roller 7. Secondary transfer residual toner remaining on the surface of the intermediate transfer belt 35 is cleaned and removed by a not-illustrated intermediate transfer belt cleaning unit.

In FIG. 1A, the description has been given by using the image forming apparatus 30 including the intermediate transfer belt 35 as an example. However, exemplary embodiments are not limited thereto. For example, an image forming apparatus is also applicable that includes a recording material conveyance belt (recording material bearing member) and employs a method for directly transferring a toner image developed on a photosensitive drum to a recording material conveyed by the recording material conveyance belt.

<Charging and Developing High-Voltage Power Sources>

Next, charging and developing high-voltage power sources will be described. The charging units 33*y*, 33*m*, and 33*c* and the developing units 34*y*, 34*m*, and 34*c* corresponding to yellow, magenta, and cyan toners are connected to a charging and developing high-voltage power source 90. The charging and developing high-voltage power source 90 supplies a charging voltage Vcdc (power supply voltage) output from a transformer 55 to the charging units 33*y*, 33*m*, and 33*c*. In addition, the charging and developing high-voltage power source 90 supplies a developing voltage Vdc divided by the two resistive elements R3 and R4 to the developing units 34*y*, 34*m*, and 34*c*. The voltages input (applied) to the charging units 33*y*, 33*m*, and 33*c* can thus be collectively adjusted while maintaining a predetermined relationship therebetween. In other words, the voltages input to the charging units 33*y*, 33*m*, and 33*c* are not capable of independent individual adjustments color by color (individual control). The same holds for the developing units 34*y*, 34*m*, and 34*c*.

The resistive elements R3 and R4 may be fixed resistances, semi-fixed resistances, or variable resistances. In the diagram, the power supply voltage from the transformer 55 is directly input to the charging units 33*y*, 33*m*, and 33*c*, and the partial voltage obtained by dividing the voltage output from the transformer 55 by the fixed partial resistances is directly input to the developing units 34*y*, 34*m*, and 34*c*. However, this is just an example, and the type of voltage input is not limited thereto. There are various possible types of voltage input to the individual rollers (charging units and developing units).

For example, a conversion voltage (converted voltage) obtained by a converter performing direct-current-to-direct-current (DC-DC) conversion on the output from the transformer 55 may be input to the charging units 33*y*, 33*m*, and 33*c* instead of the direct output from the transformer 55. A voltage obtained by dividing or stepping down the power supply voltage or the conversion voltage by an electronic element having a fixed voltage drop characteristic may be input to the charging units 33*y*, 33*m*, and 33*c* instead of the direct output from the transformer 55. A conversion voltage obtained by a converter performing DC-DC conversion on the output from the transformer 55 or a voltage obtained by dividing or stepping down the power supply voltage or the conversion voltage by an electronic element having a fixed voltage drop characteristic may be input to the developing units 34*y*, 34*m*, and 34*c*. Examples of the electronic element having the fixed voltage drop characteristic include a resistive element and a Zener diode. Converters may include a variable regulator. Dividing or stepping down a voltage by the electronic element may be carried out, for example, by further stepping down a divided voltage and vice versa.

To control the charging voltage Vcdc to remain at a substantially constant level, a negative voltage obtained by stepping down the charging voltage Vcdc by R2/(R1+R2) is offset to a voltage of positive polarity by a reference voltage Vrgv to produce a monitoring voltage Vref. Feedback control is then performed to maintain the monitoring voltage Vref at a constant value. Specifically, a control voltage Vc preset by an engine control unit (central processing unit (CPU)) is input to a positive terminal of an operational amplifier 54. On the other hand, the monitoring voltage Vref is input to a negative terminal of the operational amplifier 54. The engine control unit changes the control voltage Vc as appropriate depending on the circumstances. The output value of the operational amplifier 54 enables feedback control on the control and driving system of the transformer 55 so that the monitoring voltage Vref becomes equal to the control voltage Vc. As a result, the charging voltage Vcdc output from the transformer 55 is controlled to have a target value. The output of the transformer 55 may be controlled by inputting the output of the operational amplifier 54 into the CPU and reflecting a calculation result of the CPU on the control and driving system of the transformer 55.

The charging unit 33*k* and the developing unit 34*k* corresponding to black toner are connected to a charging and developing high-voltage power source 91. The charging and developing high-voltage power source 91 has a configuration similar to that of the foregoing charging and developing high-voltage power source 90 except that the charging voltage Vcdc is supplied to one charging unit 33*k* and the developing voltage Vdc is supplied to one developing unit 34*k*. A description thereof will thus be omitted.

As described above, the power source for supplying the charging voltage Vcdc and the developing voltage Vdc for the first to third (y, m, and c) image forming stations is separate from that for the fourth (k) image forming station.

With such a configuration, if image formation is performed in a full-color mode, the charging and developing high-voltage power sources 90 and 91 are both turned on. If image formation is performed in a monochrome mode, the charging and developing high-voltage power source 90 for the image forming stations of Y, M, and C colors can be turned off (in a non-operating state) while the charging and developing high-voltage power source 91 for the image forming station of Bk color is turned on. In the present exemplary embodiment, when the image forming stations perform image formation, the charging voltage Vcdc is controlled to be −1100 V, and the developing voltage Vdc to be −350 V.

According to such charging and developing high-voltage power sources 90 and 91, the high-voltage power sources for the plurality of charging units 33 and the plurality of developing units 34 included in the first to third (y, m, and c) image forming stations are shared each other. As compared to a configuration where separate high-voltage power sources are provided for the charging units and the developing units 34 of the respective image forming stations, the number of components of the high-voltage power sources can be reduced, which results in miniaturization and cost reduction of the image forming apparatus 30.

<Optical Scanning Unit>

Figure 2A:
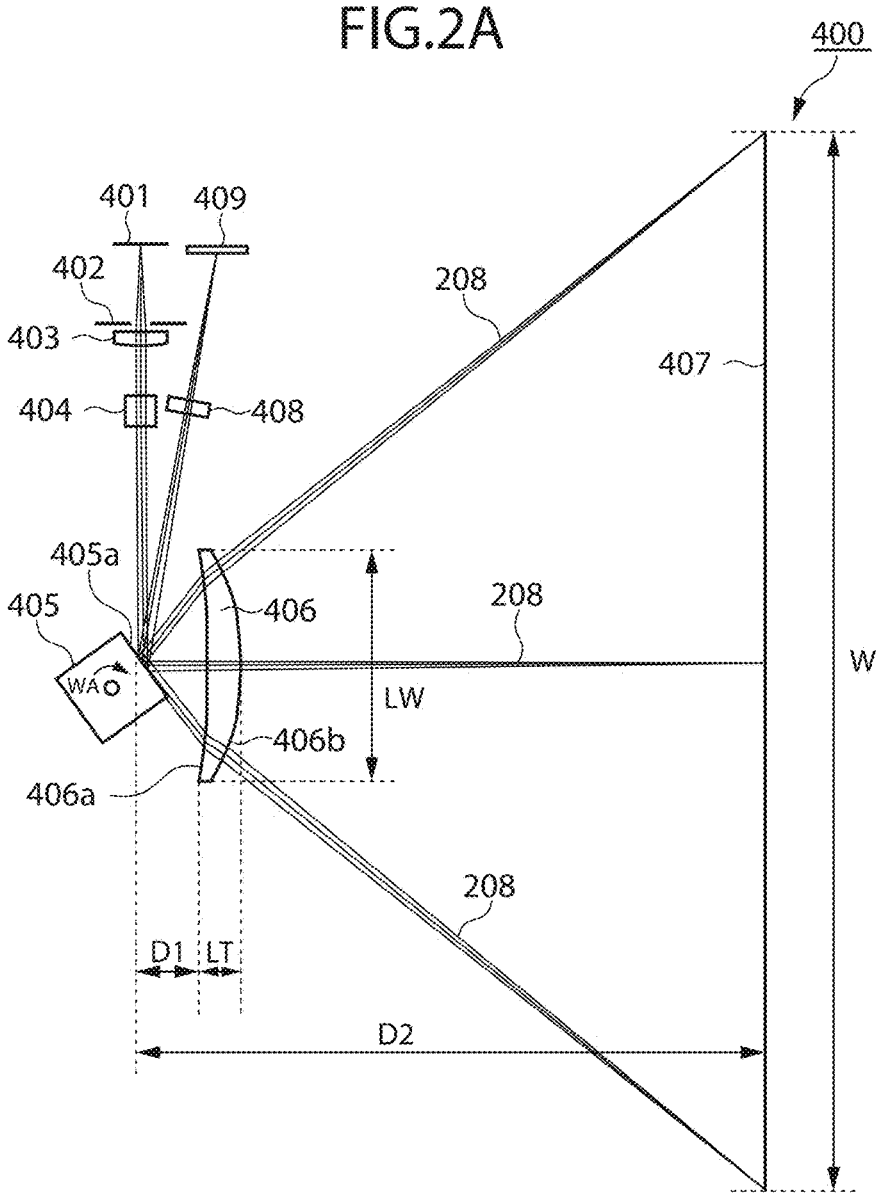
FIG. 2A is a main scanning sectional view of an optical scanning unit or scanner.
Figure 2B:
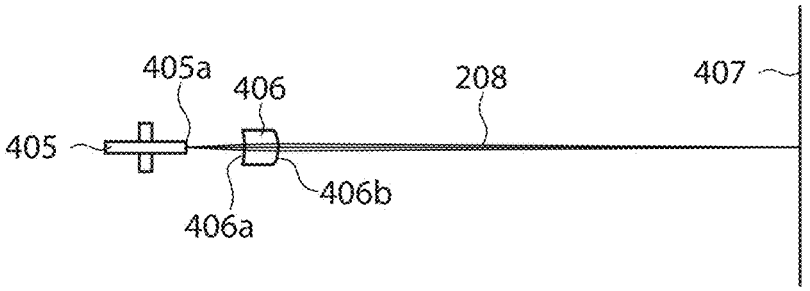
FIG. 2B is a sub scanning sectional view of the optical scanning unit or scanner.

FIGS. 2A and 2B are sectional views of an optical scanning unit 400. FIG. 2A illustrates a main scanning cross section. FIG. 2B illustrates a sub scanning cross section. As described above, the optical scanning units 400 of the image forming stations have a common configuration and control. One optical scanning unit 400 and the corresponding image forming station will be described below as a representative In the present exemplary embodiment, the laser light (light beam) 208 emitted from a light source 401 is shaped into an elliptical shape by an aperture stop 402 and incident on a coupling lens 403. The light beam which has passed through the coupling lens 403 is converted into substantially parallel light and incident on an anamorphic lens 404. The substantially parallel light may include weakly convergent light and weakly divergent light. The anamorphic lens 404 has positive refractive power within the main scanning cross section, and converts the incident light beam into convergent light within the main scanning cross section. In the sub scanning cross section, the anamorphic lens 404 condenses the light beam near a deflection surface 405*a* of a deflector 405, thereby forming a line image oblong in a main scanning direction.

The light beam which has passed through the anamorphic lens 404 is reflected by the deflection surface (reflection surface) 405*a* of the deflector (polygon mirror) 405. The light beam reflected by the reflection surface 405*a* is transmitted through an imaging lens 406 and incident on the surface of the photosensitive drum 4 as the laser light 208. In the present exemplary embodiment, a single imaging optical element (imaging lens 406) constitutes an imaging optical system. The light beam which has passed (transmitted) through the imaging lens 406 is incident on the surface of the photosensitive drum 4. The surface of the photosensitive drum 4 is a scanning target surface 407 which is scanned with the light beam. The imaging lens 406 causes the light beam on the surface of the scanning target 407 to form an image of predetermined spot shape (spot). The deflector 405 is rotated in the direction of the arrow WA at a constant angular speed by a not-illustrated driving unit, so that the spot moves over the scanning target surface 407 in the main scanning direction to form an electrostatic latent image on the scanning target surface 407. The main scanning direction refers to a direction that is parallel to the surface of the photosensitive drum 4 and orthogonal to a moving direction of the surface of the photosensitive drum 4. A sub scanning direction is a direction orthogonal to the main scanning direction and an optical axis of the light beam.

A beam detection (hereinafter, referred to as BD) sensor 409 and a BD lens 408 constitute a synchronizing optical system which determines timing at which an electrostatic latent image is written on the scanning target surface d 407. The light beam which has passed through the BD lens 408 is incident on and detected by the BD sensor 409 which includes a photodiode. The write timing is controlled based on timing at which the light beam is detected by the BD sensor 409.

The light source 401 is a semiconductor laser chip. In the present exemplary embodiment, the light source 401 is configured to include one light emitting unit 11 (see FIG. 5). However, the light source 401 may include a plurality of light emitting units capable of independent light emission control. If a plurality of light emitting units is provided, each of a plurality of generated light beams reaches the scanning target surface 407 via the coupling lens 403, the anamorphic lens 404, the deflector 405, and the imaging lens 406. Spots corresponding to the respective light beams are formed on the scanning target surface 407 at positions shifted in the sub scanning direction.

The foregoing various optical members of the optical scanning unit 400, including the light source 401, the coupling lens 403, the anamorphic lens 404, the imaging lens 406, and the deflector 405, are accommodated in a housing (optical box) 410 (410*y*, 410*m*, 410*c*, and 410*k*) (see FIG. 1).

<Exposure of Non-Image Part>

The optical scanning units 400 of the present exemplary embodiment each perform normal exposure on an image part of the corresponding photosensitive drum 4 where toner adheres to form a toner image. Meanwhile, each optical scanning unit 400 performs weak exposure on a non-image part serving as a background portion of a latent image where toner does not adhere, with an amount of exposure smaller than the normal exposure.

The reason to perform weak exposure will be described. As the use of the photosensitive drum 4 progresses, the surface of the photosensitive drum 4 becomes thinner, scraped by discharge of the discharging unit 33 and sliding of the not-illustrated cleaning unit thereon. If the photosensitive drum 4 becomes thin, a gap arises between the charging unit 33 and the photosensitive drum 4 to cause a discharge. This increases the absolute value of a charging potential Vd after the discharge. In the present exemplary embodiment, each cartridge CR can be independently attached to and detached from the main body of the image forming apparatus 30 for replacement. If there are differently operated photosensitive drums 4 (for example, different cumulative numbers of rotations) due to the replacement of the cartridges CR, the photosensitive drums 4 have variations in film thickness. If in such a state the charging and developing high-voltage power source applies the constant charging voltage Vcdc to the plurality of photosensitive drums 4, the charging potential Vd can vary from one photosensitive drum 4 to another. Specifically, the smaller the cumulative number of rotation and the greater the film thickness of the photosensitive drum 4, the smaller the absolute value of the charging potential Vd. The greater the cumulative number of rotation and the smaller the film thickness of the photosensitive drum 4, the greater the absolute value of the charging potential Vd.

In a case where the developing potential Vdc and the charging potential Vd are set, for example, with reference to a photosensitive drum 4 having a large film thickness so that a back contrast Vback (=Vd−Vdc), which is the contrast between the developing potential Vdc and the charging potential Vd, comes into a desired state, a following problem arises. If an image forming station includes a photosensitive drum 4 having a small film thickness, the absolute value of the charging potential Vd increases and the back contrast Vback increases. If the back contrast Vback is high, toner which cannot be charged in normal polarity (in the case of reversal development as in the present exemplary embodiment, the toner is charged from 0 to positive polarity instead of negative polarity) may be transferred to a non-image part from the developing unit 34, causing fogging.

To address the foregoing situation where Vback is not appropriate, weak exposure is performed on the non-image part of the photosensitive drum 4 so that the charging potential Vd of the non-image part is further attenuated to a weakly-exposed potential Vdbg. As a result, the back contrast Vback, i.e., the contrast between the developing potential Vdc and the charging potential Vd becomes the contrast between the developing potential Vdc and the weakly-exposed potential Vdbg, whereby the back contrast Vback can be suppressed. This can suppress image defects due to the foregoing inappropriate Vback.

<Imaging Lens>

As illustrated in FIG. 2, the imaging lens 406 has two optical surfaces (lens surfaces) including an incident surface (first surface) 406*a* and an emission surface (second surface) 406*b*. The imaging lens 406 is configured to scan the scanning target surface 407 with the light beam deflected by the deflection surface 405*a* with a desired scanning characteristic within the main scanning cross section. The imaging lens 406 is also configured to shape the spot of the laser light 208 on the scanning target surface 407 into a desired shape. Further, in the sub scanning cross section, the imaging lens 406 is configured so that the vicinity of the deflection surface 405*a* and the vicinity of the scanning target surface 407 have a conjugate relationship. The imaging lens 406 is configured to thereby compensate a face tangle (reduce a deviation of the scanning position on the scanning target surface 407 in the sub scanning direction if the deflection surface 405*a* is tilted).

The imaging lens 406 according to the present exemplary embodiment is a plastic mold lens formed by injection molding. However, a glass mold lens may be used as the imaging lens 406. Mold lenses are easy to form in an aspherical shape and are suitable for mass production. The use of a mold lens as the imaging lens 406 can thus improve productivity and optical performance of the imaging lens 406.

The imaging lens 406 does not have an fθ characteristic. That is, the imaging lens 406 does not have a scanning characteristic such that when the deflector 405 rotates at a constant angular speed, the spot of the light beam which has passed through the imaging lens 406 moves over the scanning target surface 407 at a constant speed. By using such an imaging lens 406 not having an fθ characteristic, the imaging lens 406 can be arranged close to the deflector 405 (in a position where a distance D1 is small). In addition, as compared to an imaging lens having an fθ characteristic, the imaging lens 406 not having an fθ characteristic can be made smaller in the main scanning direction (width LW) and the optical axis direction (thickness LT). This achieves miniaturization of the housing 410 (see FIG. 1) of the optical scanning apparatus 400. Furthermore, if a lens has an fθ characteristic, shapes of the incident surface and emission surface of the lens may sharply change when seen in the main scanning cross section. When there are such constraints in shape, favorable imaging performance cannot be obtained. In contrast, since the imaging lens 406 does not have an fθ characteristic, and the incident surface and emission surface of the imaging lens 406 does not sharply change when seen in the main scanning cross section, favorable imaging performance can thus be obtained.

The scanning characteristic of such an imaging lens 406 according to the present exemplary embodiment is expressed by the following Eq. (1):

$$Y = \frac{K}{B}\tan(B\theta) \tag{1}$$

In Eq. (1), θ is a scanning angle (scanning angle of view) of the deflector 405, Y [mm] is a condensing position (image height) of the light beam on the scanning target surface 407 in the main scanning direction, K [mm] is an imaging coefficient at an axial image height, and B is a coefficient (scanning characteristic coefficient) for determining the scanning characteristic of the imaging lens 406. In the present exemplary embodiment, the axial image height refers to the image height on the optical axis (Y=0=Ymin) and corresponds to a scanning angle of θ=0. An off-axis image height refers to an image height (Y≠0) outside a center optical axis (at a scanning angle of θ=0) and corresponds to a scanning angle of θ≠0. An outermost off-axis image height refers to an image height (Y=+Ymax, −Ymax) at a maximum scanning angle θ (maximum scanning angle of view). A scanning width W, which is the width in the main scanning direction of a predetermined area (scanning area) of the scanning target surface 407 where a latent image can be formed, is expressed by W=|+Ymax|+|−Ymax|. The axial image height falls on the center of the predetermined area, and the outermost off-axis image heights on the ends.

The imaging coefficient K is a coefficient corresponding to f in the scanning characteristic (fθ characteristic) Y=fθ when parallel light is incident on the imaging lens 406. In other words, the imaging coefficient K is a coefficient for establishing a proportional relationship between the conversing position Y and the scanning angle θ similar to the fθ characteristic when a light beam other than parallel light is incident on the imaging lens 406.

The scanning characteristic coefficient B will be further described. If B=0, Eq. (1) yields Y=Kθ, which corresponds to the scanning characteristic Y=fθ of an imaging lens used in conventional optical scanning units. If B=1, Eq. (1) yields Y=K·tan θ, which corresponds to the projection characteristic Y=f·tan θ of a lens used in an imaging apparatus (camera). That is, the scanning characteristic coefficient B in Eq. (1) can be set within the range of 0≤B≤1 to obtain a scanning characteristic between the projection characteristic Y=f·tan θ and the fθ characteristic Y=fθ.

Eq. (1) differentiated by the scanning angle θ yields the scanning speed of the light beam on the scanning target surface 407 relative to the scanning angle θ as expressed by the following Eq. (2):

$$\frac{dY}{d\theta} = \frac{K}{\cos^2(B\theta)} \tag{2}$$

Eq. (2) further divided by the speed of dy/dθ=K at the axial image height yields the following Eq. (3):

$$\frac{\frac{dY}{d\theta}}{K} - 1 = \frac{1}{\cos^2(B\theta)} - 1 = \tan^2(B\theta) \quad (3)$$

Eq. (3) expresses the amount of shift (partial magnification) of the scanning speed at each off-axis image height relative to the scanning speed at the axial image height. In the optical scanning unit 400 according to the present exemplary embodiment, the scanning speed of the light beam at the axial image height is different from that at off-axis image heights except where B=0.

Figure 3:
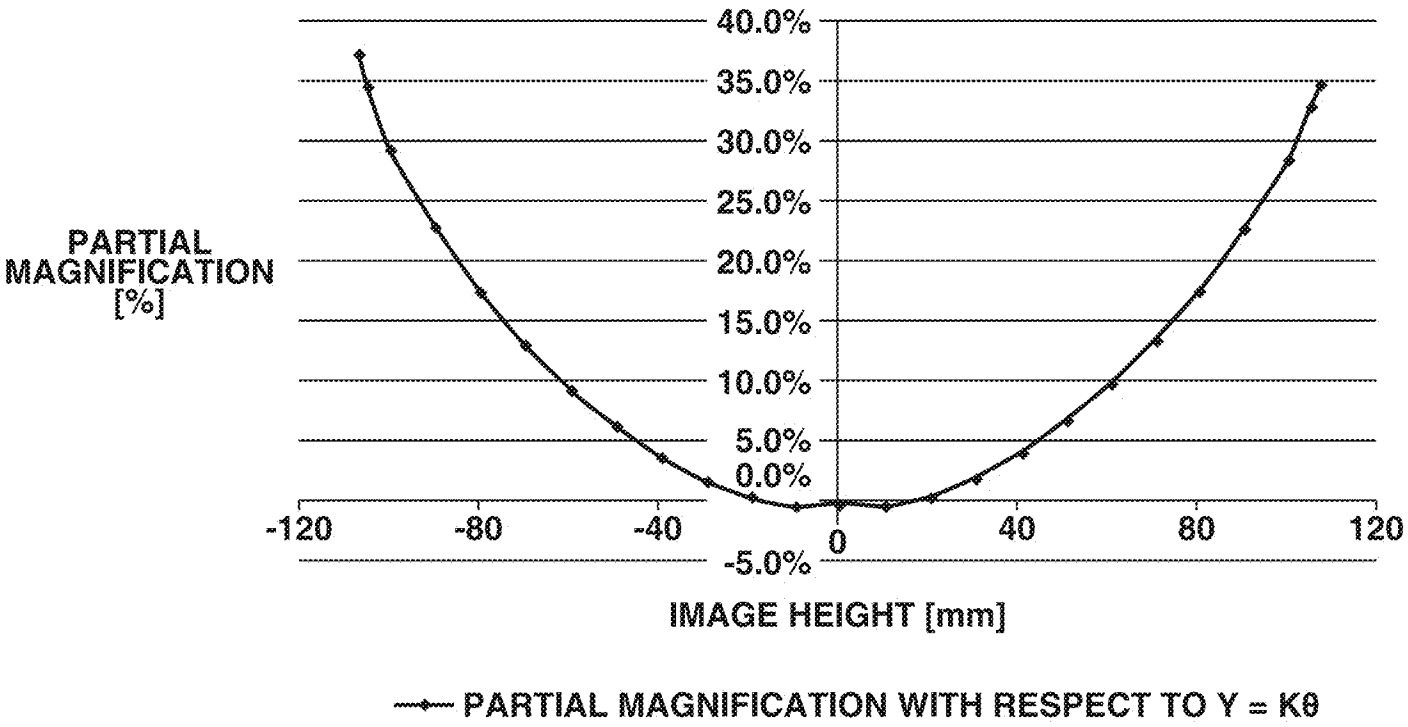
FIG. 3 is a characteristic graph of a partial magnification of the optical scanner with respect to an image height.

FIG. 3 illustrates the relationship between the image height Y and the partial magnification when the scanning position on the scanning target surface 407 according to the present exemplary embodiment is fitted to the characteristic of Y=Kθ. In the present exemplary embodiment, the imaging lens 406 is given the scanning characteristic expressed by Eq. (1). As illustrated in FIG. 3, the scanning speed increases gradually and the partial magnification increases as the image height Y shifts from the axial image height to off-axis image heights. A partial magnification of 30% means that light irradiation in a unit time results in 1.3 times irradiation length on the scanning target surface 407 in the main scanning direction. Thus, if pixel widths in the main scanning direction are defined by constant time intervals determined from the cycles of an image clock, a pixel density at the axial image height becomes different from that at off-axis image heights.

Further, as the image height Y shifts from the axial image height to approach the outermost off-axis image heights (as the image height Y increases in absolute value), the scanning speed increases gradually. Consequently, the time needed to scan a unit length when the image height Y on the scanning target surface 407 is near the outermost off-axis image heights, becomes shorter than the time needed to scan a unit length when the image height Y is near the axial image height. This means that if the light source 401 has a constant light emission luminance, the total amount of exposure per unit length when the image height Y is near the axial image height, becomes smaller than the total amount of exposure per unit length when the image height Y is near the outermost off-axis image heights.

Accordingly, with the foregoing optical configuration as described above, variations in the partial magnification with respect to the main scanning direction and variations in the total amount of exposure per unit length may be not appropriate in maintaining favorable image quality. Therefore, in the present exemplary embodiment, to obtain favorable image quality, correction of the foregoing partial magnification and luminance correction for correcting the total amount of exposure per unit length are performed.

In particular, as the optical path length from the deflector 405 to the photosensitive drum 4 decreases, the angle of view increases and the difference between the scanning speed at the axial image height and that at the outermost off-axis image heights increases. According to a study by the inventors, the optical configuration may have a change rate of 20% or more in the scanning speed, where the scanning speed at the outermost off-axis image heights is 120% or more of the scanning speed at the axial image height. Such an optical configuration is susceptible to variations in the partial magnification with respect to the main scanning direction and variations in the total amount of exposure per unit time, and it becomes difficult to maintain favorable image quality.

The change rate C (%) of the scanning speed is a value expressed as C=((Vmax−Vmin)/Vmin)*100, where Vmin is the slowest scanning speed and Vmax is the fastest scanning speed. In the optical configuration according to the present exemplary embodiment, the slowest scanning speed occurs at the axial image height (at the center of the scanning area), and the fastest scanning speed at the outermost off-axis image heights (at the ends of the scanning area).

According to a study by the inventors, it has been found that an optical configuration having an angle of view of 52° or more reaches or exceeds 35% in the change rate C of the scanning speed. Conditions for the angle of view of 52° or more are as follows: For example, suppose that an optical configuration forms a latent image having the width of the short side of an A4 sheet in the main scanning direction. In such a case, the scanning width W is 214 mm, and an optical path length D2 (see FIG. 2A) from the deflection surface 405*a* at a scanning angle of view of 0° to the scanning target surface 407 is 125 mm or less. Suppose that an optical configuration forms a latent image having the width of the short side of an A3 sheet in the main scanning direction. In such a case, the scanning width W is 300 mm, and the optical path length D2 (see FIG. 2A) from the deflection surface 405*a* at a scanning angle of view of 0° to the scanning target surface 407 is 247 mm or less. An image forming apparatus 30 including such an optical configuration can provide favorable image quality by using the configuration of the present exemplary embodiment described below even when an imaging lens not having an fθ characteristic is used.

<Exposure Control Configuration>

Figure 5:
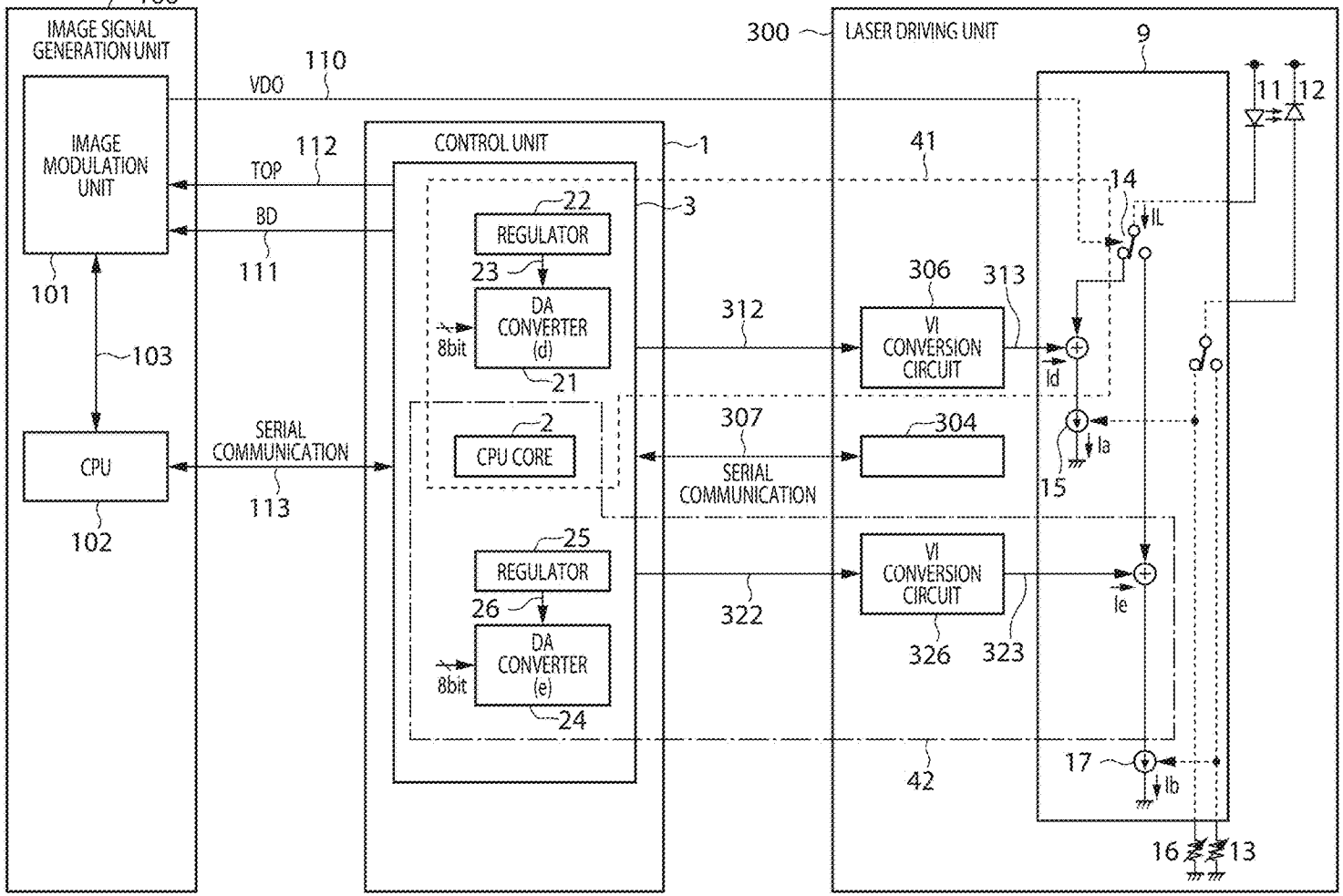
FIG. 5 is an electrical block diagram illustrating an exposure control configuration of the first exemplary embodiment.

FIG. 5 is an electrical block diagram illustrating an exposure control configuration in the image forming apparatus 30. The image signal generation unit 100 receives print information from a not-illustrated host computer, and generates a VDO signal 110 corresponding to image data (image signal). The laser driving unit 300 is provided in each optical scanning unit 400. The laser driving unit 300 makes the light source 401 emit light with a first light emission luminance with respect to an image part of the photosensitive drum 4 where toner adheres to. The laser driving unit 300 thereby exposes the image part of the photosensitive drum 4 to the light so that toner adheres thereto in a desired density. The laser driving unit 300 further makes the light source 401 emit light with a second light emission luminance with respect to a non-image part of the photosensitive drum 4 where toner does not adhere to. The laser driving unit 300 thereby exposes the non-image part of the photosensitive drum 4 to the light so that the non-image part attenuates to a potential at which no toner adheres. The second light emission luminance is lower than the first light emission luminance. Such exposure of the non-image part can appropriately adjust the potential of the non-image part and suppress adhesion of toner to the non-image part due to a fogging phenomenon which might cause an image defect.

The image signal generation unit 100 also has a function as a pixel distance correction unit or corrector. The control unit, or controller, 1 controls the image forming apparatus 30 and functions as a luminance correction unit. The luminance correction unit or corrector controls each optical scanning unit 400 in terms of the light emission luminance of the light source 401 when the light source 401 emits light with respect to the image part where toner adheres to and when the light source 401 emits light with respect to the non-image part where toner does not adhere to. Each laser driving unit 300 supplies a current to the light source 401 based on the VDO signal 110, thereby making the light source 401 emit light. That is, the VDO signal 110 is a light emission signal for switching between supplying and not supplying the current to the light source 401 to make the light source 401 emit light at a desired time interval.

When the image signal generation unit 100 is ready to output an image signal for image formation, the image signal generation unit 100 instructs the control unit 1, via serial communication 113, to start printing. When the control unit 1 is ready for printing, the control unit 1 transmits a TOP signal 112 and a BD signal 111 to the image signal generation unit 100. The TOP signal 112 is a sub scanning synchronization signal. The BD signal 111 is a main scanning synchronization signal. Upon receiving the TOP signal 112, the image signal generation unit 100 outputs the VDO signal 110, which is an image signal, to each laser driving unit 300 at predetermined timing. Main component blocks of the image signal generation unit 100, the control unit 1, and the laser driving unit 300 will be described below.

Figure 6A:
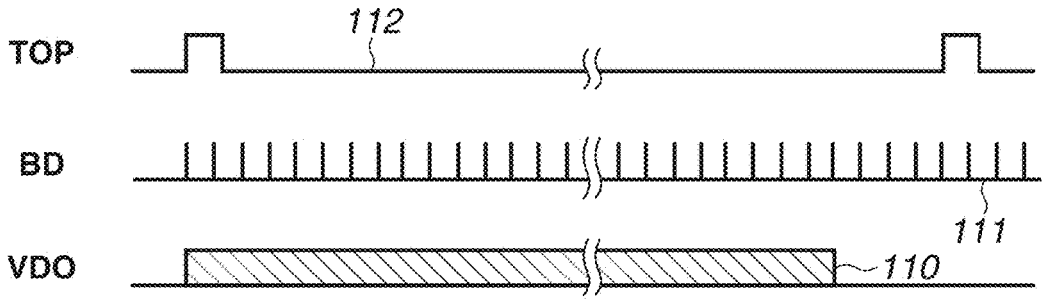
FIG. 6A is a timing chart of synchronization signals and an image signal.

FIG. 6A is a timing chart of various synchronization signals and the image signal when performing an image forming operation for one page of recording medium. Time elapses from the left to the right in the chart. A "high" of the TOP signal 111 indicates that the leading edge of a recording medium reaches a predetermined position. If the image signal generation unit 100 receives the "high" of the TOP signal 112, the image signal generation unit 100 transmits the VOD signal 110 in synchronization with the BD signal 111. Based on the VDO signal 110, the light source 401 emits laser light to form a latent image on the photosensitive drum 4.

For simplification of the drawing, in FIG. 6A, the VDO signal 110 is illustrated to be continuously output across a plurality of BD signals 111. In fact, the VDO signal 110 is output for a predetermined period between when a BD signal 111 is output and when the next BD signal 111 is output.

<Partial Magnification Correction Method>

Figure 6B:
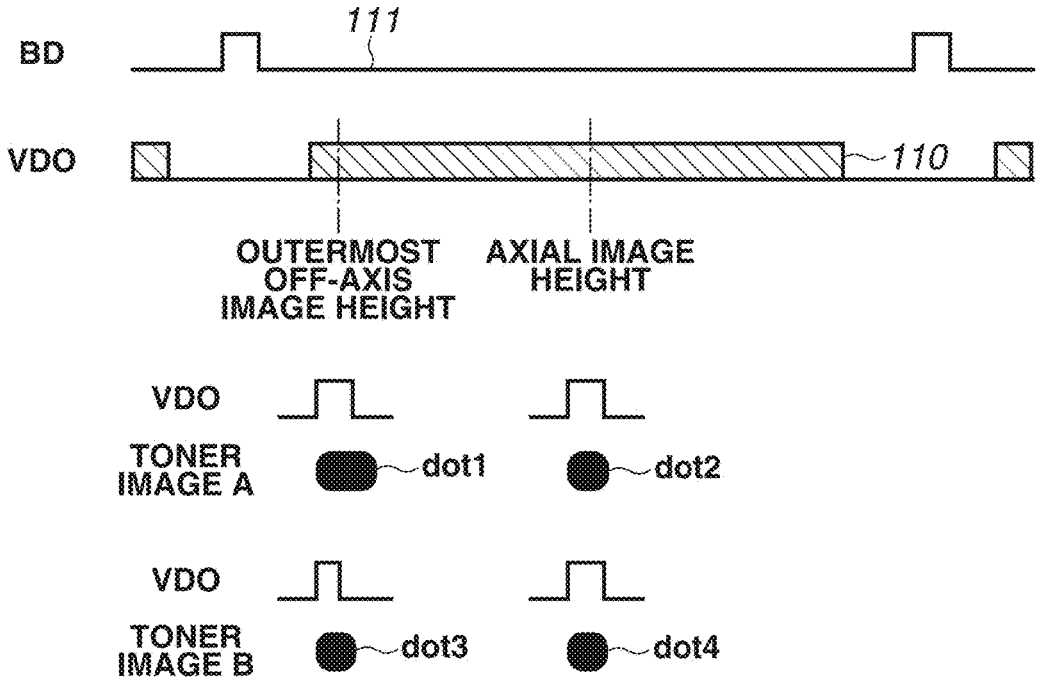
FIG. 6B is a diagram illustrating a timing chart of a beam detection (BD) signal and the image signal, and dot images on a scanning target surface.

Next, a partial magnification correction method for correcting an increase or decrease in the pixel width according to a difference in the scanning speed will be described. Before the description, the cause and the correction principle of the partial magnification will be described with reference to FIG. 6B. FIG. 6B is a diagram illustrating the timing of the BD signal 111 and the VOD signal 110 and dot images formed by latent images on the scanning target surface 407. Time elapses from the left to the right of the diagram.

If the image signal generation unit 100 receives a rising edge of the BD signal 111, the image signal generation unit 100 transmits the VDO signal 110 after a predetermined time so that a latent image can be formed in a position located at a desired distance from the left end of the photosensitive drum 4. Based on the VDO signal 110, the light source 401 emits laser light to form the latent image according to the VDO signal 110 on the scanning target surface 407.

Here, a case will be described where the light source 401 emits light for a same period of time to form dot-shaped latent images at the axial image height and at an outermost off-axis image height based on the VDO signal 110. The dot size corresponds to one 600-dpi dot (42.3 μm in width in the main scanning direction). As described above, the optical scanning unit 400 has the optical configuration such that the scanning speed at the ends (outermost off-axis image heights) is faster than in the central portion (axial image height) on the scanning target surface 407. As illustrated by a toner image A, a latent image dot1 at the outermost off-axis image height becomes greater in the main scanning direction than a latent image dot2 at the axial image height. Then, in the present exemplary embodiment, partial magnification correction is performed to correct the cycle or time width of the VDO signal 110 according to the position in the main scanning direction. More specifically, by the partial magnification correction, the time interval of light emission at the outermost off-axis image height is shortened than at the axial image height so that, as illustrated by a toner image B, a latent image dot3 at the outermost off-axis image height and a latent image dot4 at the axial image height have substantially the same size. Such a correction makes it possible to form dot-shaped latent images corresponding to respective pixels at substantially equal intervals in the main scanning direction.

Figure 7:
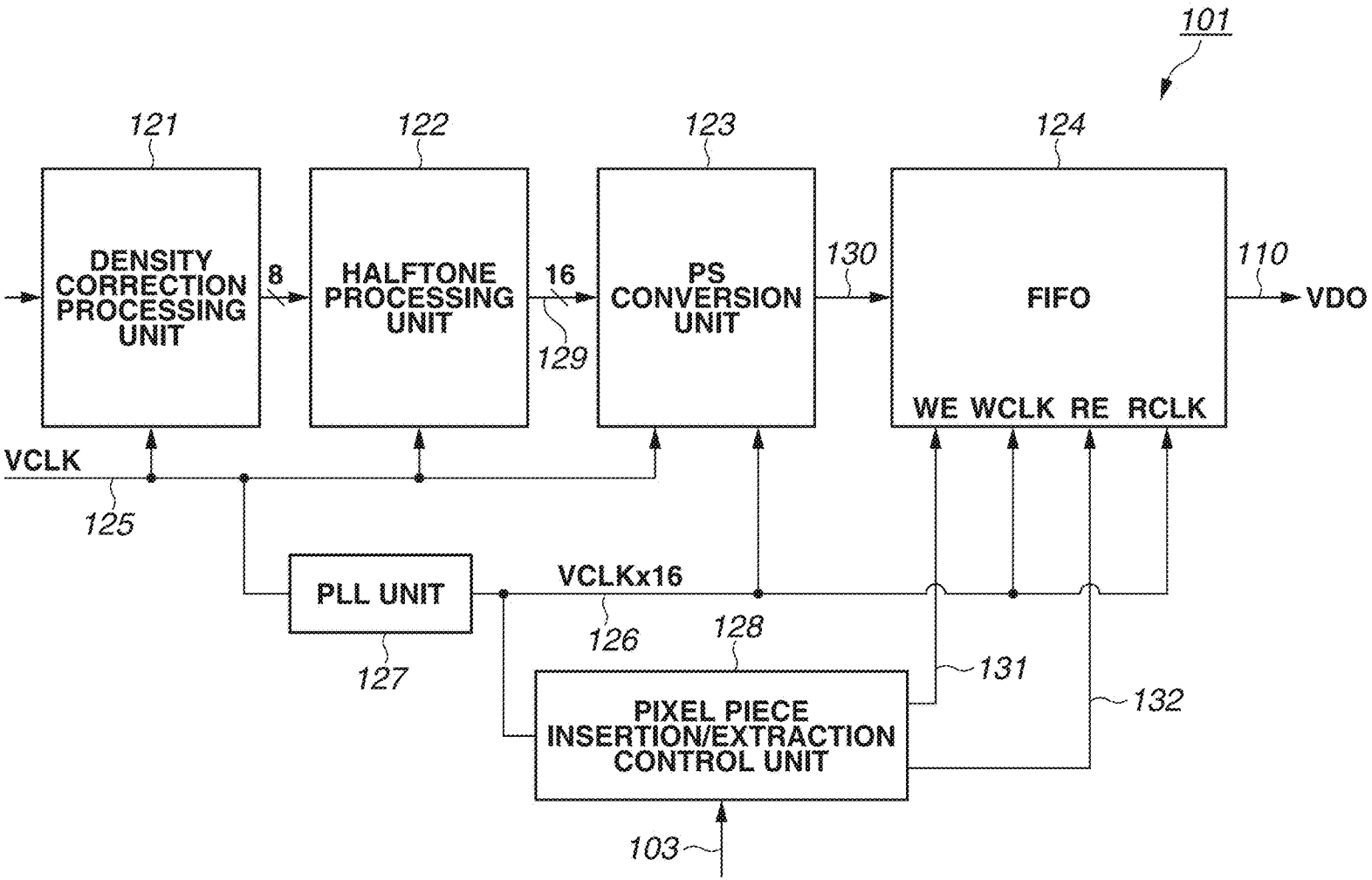
FIG. 7 is a block diagram illustrating an image modulation unit, or modulator, according to the first, a second, and a fourth exemplary embodiment.

Next, referring to FIGS. 7 to 11B, specific processing of the partial magnification correction will be described in which irradiation time of the light source 401 is reduced by an partial magnification increase amount as the image height Y shifts from the axial image height to off-axis image heights. FIG. 7 is a block diagram illustrating an example of an image modulation unit 101. A density correction processing unit 121 stores a density correction table for printing the image signal received from the not-illustrated host computer in an appropriate density. A halftone processing unit 122 performs screen (dither) processing on an input multivalued parallel 8-bit image signal to perform conversion processing to present densities in the image forming apparatus 30.

Figure 8A:
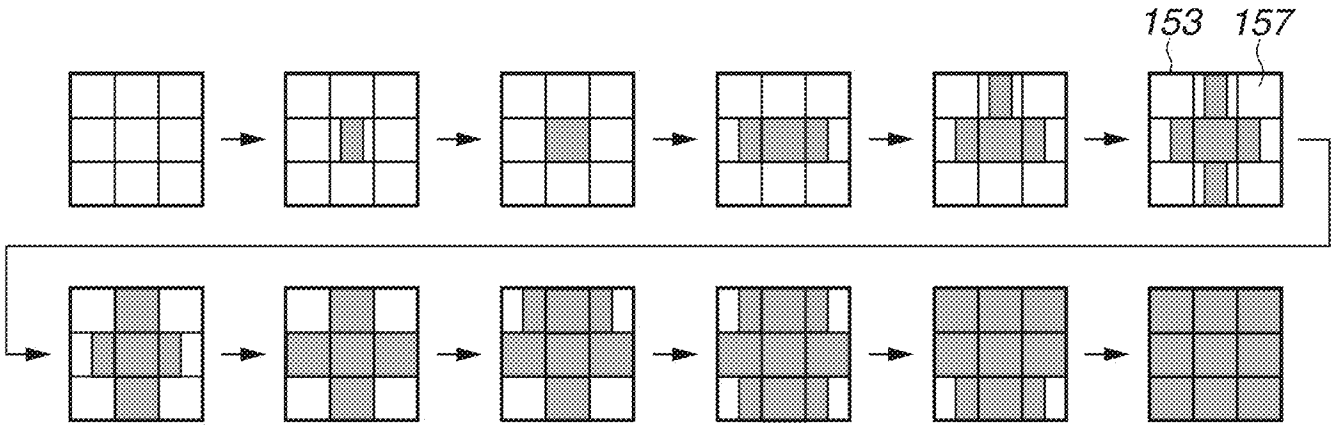
FIG. 8A is a diagram illustrating an example of a screen.
Figure 8B:
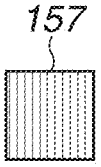
FIG. 8B is a diagram for describing a pixel and pixel pieces.

FIG. 8A illustrates an example of a screen 153. The screen 153 presents densities with a 200-line matrix which is an assembly of three main scanning pixels by three sub scanning pixels. White portions in the diagram are where the light source 401 does not emit light (OFF portions). Black portions are where the light source 401 emits (turns on) pulsed light (ON portions). The screen 153 is provided for each gradation. The turn-on ratio within the screen 153 increases and the gradation ascends (density increases) in the order illustrated by the arrows. In the present exemplary embodiment, one pixel 157 is a unit for sectioning image data to form one 600-dpi dot on the scanning target surface 407. As illustrated in FIG. 8B, before the correction of the pixel width, one pixel consists of 16 pixel pieces each having a width of 1/16 of one pixel. The light emission of the light source 401 can be switched on/off for each pixel piece. In other words, one pixel can express 16 steps of gradation. A parallel-serial (PS) conversion unit 123 converts a parallel 16-bit signal 129 input from the halftone processing unit 122 into a serial signal 130. A first-in first-out (FIFO) 124 receives and stores the serial signal 130 in a not-illustrated line buffer. After a predetermined time elapses, the FIFO 124 outputs the stored serial signal 130 to the laser driving unit 300 in the subsequent stage as the VDO signal 110 which is also a serial signal. A pixel piece insertion/extraction control unit 128 performs write and read control of the FIFO 124 by controlling a write enable signal WE 131 and a read enable signal RE 132 based on partial magnification characteristic information which is received from a CPU 102 via a CPU bus 103. A phase locked loop (PLL) unit 127 supplies clock (VCLKx16) 126, which is obtained by multiplying a frequency of clock (VCLK) 125 corresponding to one pixel by 16, to the PS conversion unit 123 and the FIFO 124.

Figure 9:
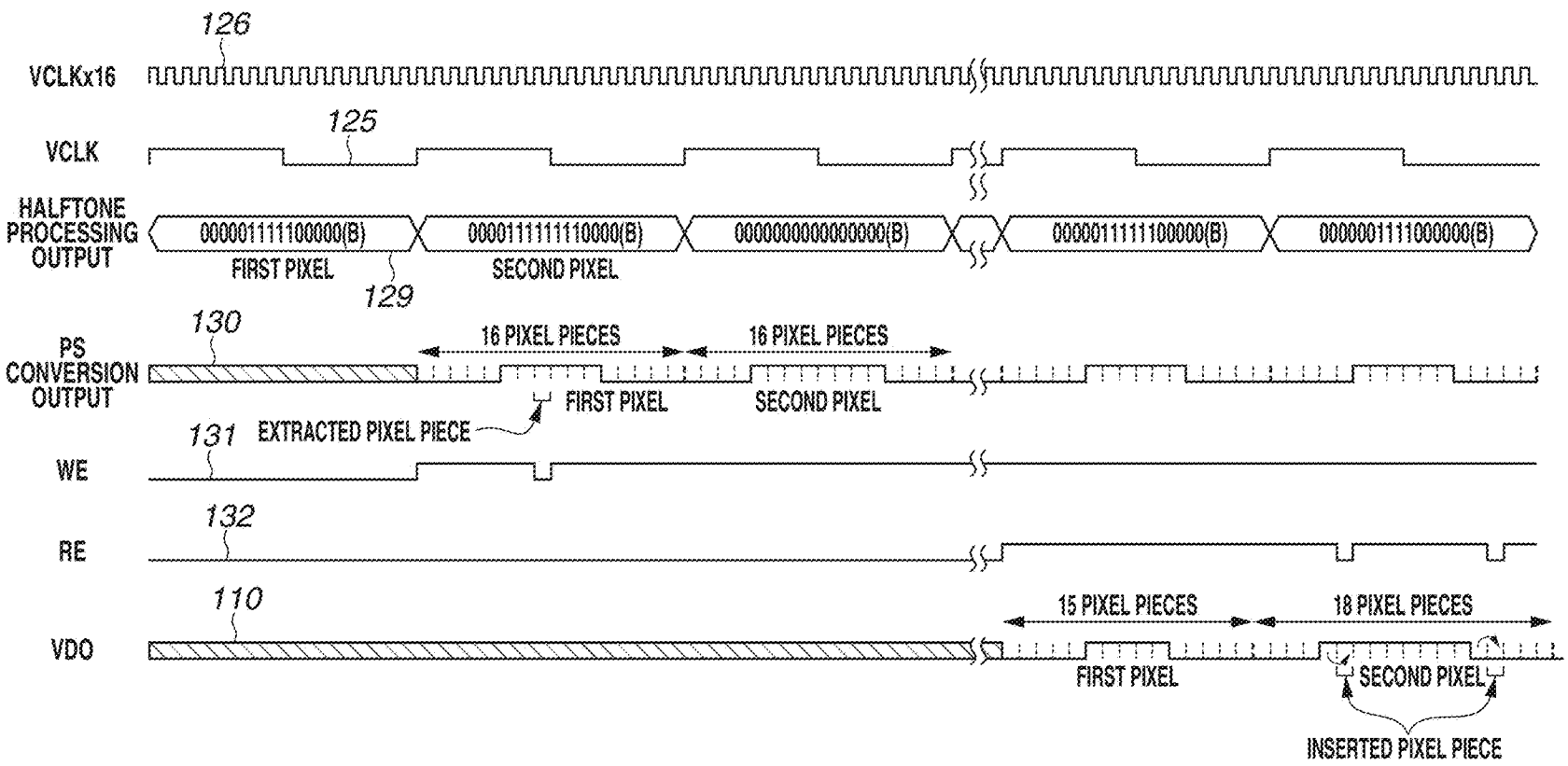
FIG. 9 is a timing chart related to an operation of the image modulation unit.

Next, an operation subsequent to the halftone processing in the block diagram of FIG. 7 will be described by using a timing chart of FIG. 9 with respect to an operation of the image modulation unit 101. As described above, the PS conversion unit 123 captures the multivalued 16-bit signal 129 from the halftone processing unit 122 in synchronization with the clock 125, and transmits the serial signal 130 to the FIFO 124 in synchronization with the clock 126.

The FIFO 124 receives the signal 130 only if the write enable signal WE 131 is active, i.e., "high." To shorten an image in the main scanning direction for the sake of partial magnification correction, the pixel piece insertion/extraction control unit 128 partially invalidates the write enable signal WE 131 to "low" so that the FIFO 124 does not receive the serial signal 130. In other words, the pixel piece insertion/extraction control unit 128 extracts a pixel piece. FIG. 9 illustrates an example of a configuration where a normal pixel includes 16 pixel pieces and one pixel piece is extracted from a first pixel so that the first pixel includes 15 pixel pieces.

The FIFO 124 reads out the stored data in synchronization with the clock 126 (VCLKx16) and outputs the VDO signal 110 only if the read enable signal RE 132 is active, i.e., "high." In extending an image in the main scanning direction for the sake of partial magnification correction, the pixel piece insertion/extraction control unit 128 partially invalidates the read enable signal RE 132 to "low" so that the FIFO 124 does not update the read data and continues outputting the data of the previous clock of the clock 126. That is, the pixel piece insertion/extraction control unit 128 inserts a pixel piece of the same data as the pixel piece that has just been processed and adjoins upstream in the main scanning direction. In such a manner, the pixel piece insertion/extraction control unit 128 plays the role of a pixel distance correction unit or a pixel distance corrector. FIG. 9 illustrates an example of a configuration where a normal pixel includes 16 pixel pieces and two pixel pieces are inserted into a second pixel so that the second pixel includes 18 pixel pieces. Note that the FIFO 124 used in the present exemplary embodiment is described as a circuit that is configured to continue outputting the previous output instead of bringing the output into a Hi-Z state if the read enable signal RE 132 is invalidated to "low."

FIGS. 10A to 11B are diagrams for describing the parallel 16-bit signal 129, which is an image input to the halftone processing unit 122, up to the VDO signal 110, which is an output of the FIFO 124, by using picture images.

Figure 10A:
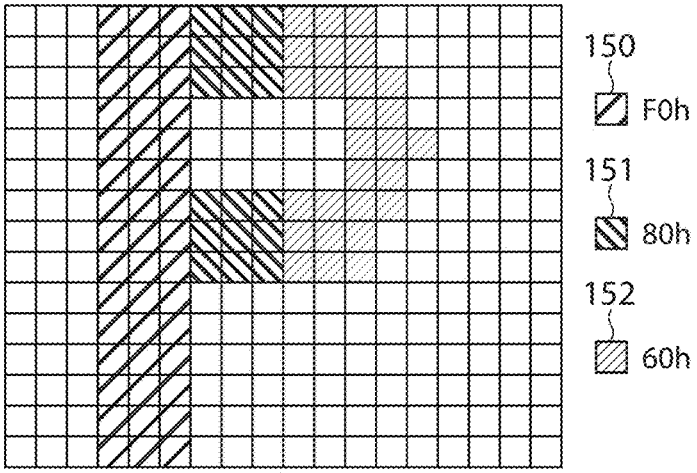
FIG. 10A is a diagram illustrating an example of an image signal input to a halftone processing unit.
Figure 10B:
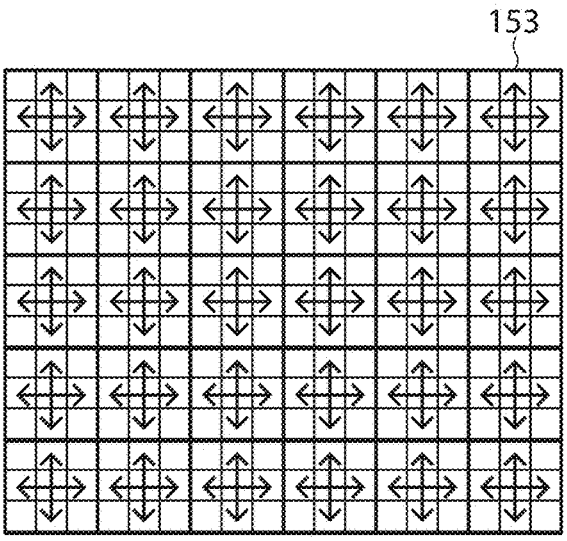
FIG. 10B is a diagram for illustrating screens.
Figure 10C:
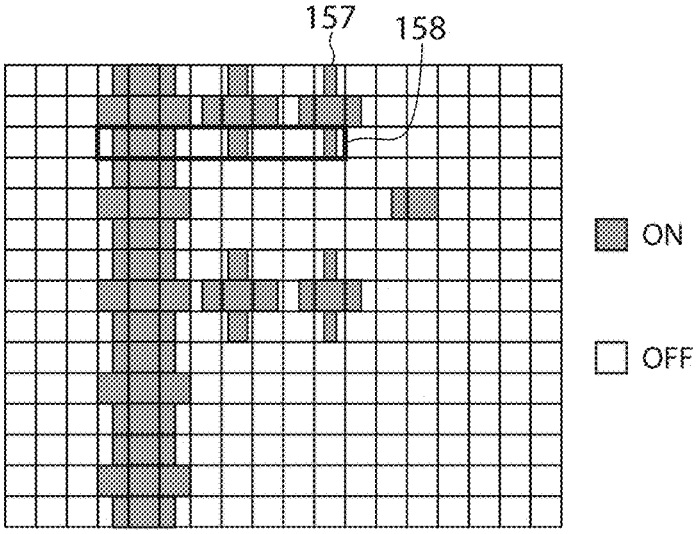
FIG. 10C is a diagram for illustrating an example of the image signal after halftone processing.

FIG. 10A illustrates an example of a multivalued parallel 8-bit image signal input to the halftone processing unit 112. Each pixel includes 8-bit density information. Pixels 150 include density information F0h. Pixels 151 are density information 80h. Pixels 152 are density information 60h. White background portions are density information 00h. FIG. 10B illustrates screens 153. As described in FIGS. 8A and 8B, the screens 153 are a 200-line screen that grows from the center. FIG. 10C illustrates a picture image of an image signal that is the parallel 16-bit signal 129 after the halftone processing is performed. As described above, each pixel 157 includes 16 pixel pieces.

Figure 11A:
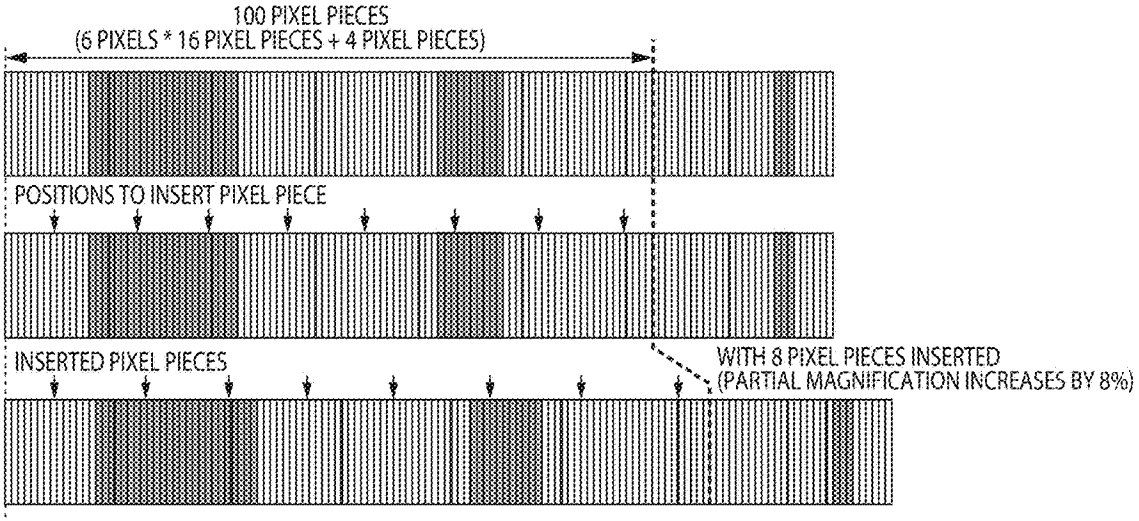
FIG. 11A is a diagram for describing insertion of pixel pieces.
Figure 11B:
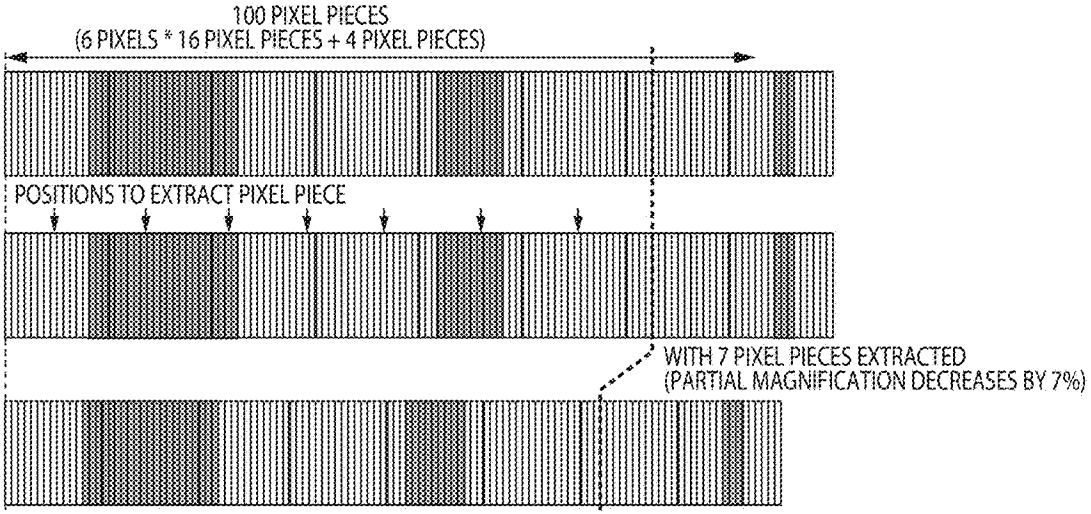
FIG. 11B is a diagram for describing extraction of pixel pieces.

FIGS. 11A and 11B illustrate an example of inserting pixel pieces to extend an image and an example of extracting pixel pieces to shorten an image, focusing attention on an area 158 of eight pixels in the main scanning direction in FIG. 10C. FIG. 11A illustrates an example of increasing the partial magnification by 8%. A total of eight pixel pieces are inserted into a continuous group of 100 pixel pieces at equal or substantially equal intervals. This can change the pixel widths to increase the partial magnification by 8%, whereby the latent images are extended in the main scanning direction. FIG. 11B illustrates an example of decreasing the partial magnification by 7%. A total of seven pixel pieces are extracted from a continuous group of 100 pixel pieces at equal or substantially equal intervals. This can change the pixels widths to reduce the partial magnification by 7%, whereby the latent images are shortened in the main scanning direction. Such a method can generate a VDO signal 110 (light emission signal) corresponding to image data into/from which a pixel piece having a length smaller than a single pixel of the image data in the main scanning direction is inserted or extracted. In the partial magnification correction, length of the pixel widths is changed to be smaller than a pixel in the main scanning direction so that dot-shaped latent images corresponding to the respective pixels of the image data can be formed at substantially equal intervals in the main scanning direction. Substantially equal intervals in the main scanning direction may cover a case where the pixels are not arranged at perfectly equal intervals. More specifically, as a result of the partial magnification correction, the pixel intervals may have some variations as long as average pixel intervals within a predetermined image height range are equal. As described above, if pixel pieces are inserted or extracted at equal or substantially equal intervals, a difference between the numbers of pixel pieces constituting two adjoining pixels is 0 or 1. This suppresses variations in the image density in the main scanning direction as compared to the original image data, and thus favorable image quality can be obtained. The positions where pixel pieces are inserted or extracted in the main scanning direction may be the same or different between scanning lines (lines).

As described above, as the image height Y increases in absolute value, the scanning speed increases. In the partial magnification correction, the foregoing insertion and extraction of pixel pieces is thus performed so that the image becomes shorter (the length of a pixel decreases) as the image height Y increases in absolute value. By such correction of the pixel intervals in the main scanning direction, latent images corresponding to respective pixels can be formed at substantially equal intervals in the main scanning direction to appropriately correct the partial magnification. In addition to the foregoing method using the insertion and extraction of pixel pieces, a method for changing the frequency of the image clock during scanning may be used as the method for correcting the pixel intervals in the main scanning direction (partial magnification correction method). The image clock refers to the clock for synchronizing the VDO signal 110 when the VDO signal 110 corresponding to the image data of FIG. 5 is output from the image signal generation unit 100 to the laser driving unit 300. The frequency of the image clock determines a time interval corresponding to one pixel of the image data. Therefore, during one scan, the frequency of the image clock is gradually reduced as the image height Y shifts from the outermost off-axis image height to the axial image height, and the frequency of the image click is gradually increased as the image height Y shifts from the axial image height to the outermost off-axis image height. In such a manner, the pixel intervals in the main scanning direction can be corrected so that latent images corresponding to respective pixels are formed at substantially equal intervals in the main scanning direction.

<Total Exposure Amount Correction>

Next, total exposure amount correction will be described. The total exposure amount correction is intended to control the total amount of exposure to be uniform at any pixels having identical densities in the main scanning direction of the photosensitive drum 4. Herein, the total amount of exposure refers to an integral light amount obtained by multiplying the irradiation time and the luminance of the laser light 208.

Because of the partial magnification correction by the foregoing insertion and extraction of pixel pieces, the irradiation time of the laser light 208 increases as the image height Y decreases in absolute value.

The scanning speed of the laser light 208 on the photosensitive drum 4 decreases as the absolute value of the image height Y decreases. Accordingly, the irradiation time of the laser light 208 increases as the image height Y decreases in absolute value. Therefore, one method for making the total light amount constant is luminance correction for reducing luminance as the image height Y decreases in absolute value.

<Luminance Correction>

Next, the luminance correction will be described with reference to FIGS. 5, 12A, 12B, and 13. The control unit 1 of FIG. 5 includes an integrated circuit (IC) 3 which includes a CPU core 2, two 8-bit digital-to-analog (DA) converters 21 and 24, and two regulators 22 and 25. The control unit 1 constitutes a first luminance correction unit 41 and a second luminance correction unit 42 in combination with the laser driving unit 300. The laser driving unit 300 includes a memory 304, voltage-current (VI) conversion circuits 306 and 326 which convert a voltage into a current, and a laser driver IC 9 which is an example of a luminance control unit. The laser driving unit 300 supplies a driving current to the light emitting unit 11, which is a laser diode, of the light source 401. The memory 304 serving as a storage unit stores partial magnification characteristic information 317 and information about a correction current supplied to the light emission unit 11. The partial magnification characteristic information is information corresponding to a plurality of image heights in the main scanning direction. Instead of the partial magnification information, characteristic information about the scanning speed on the scanning target surface 407 may be used.

Next, an operation of the laser driving unit 300 will be described. Based on information about a correction current of an image part with respect to the light emitting unit 11 stored in the memory 304, the IC 3 adjusts and outputs a voltage 23 output from the regulator 22. The voltage 23 serves as a reference voltage of the DA converter 21. The IC 3 then sets input data of the DA converter 21, and outputs an image luminance correction analog voltage 312, which increases or decreases within a main scan, in synchronization with the BD signal 111. The VI conversion circuit 306 in the subsequent stage converts the image luminance correction analog voltage 312 into a VI conversion output current value Id 313, which is output to the laser driver IC 9. Similarly, based on information about a correction current of a non-image part with respect to the light emitting unit 11 stored in the memory 304, the IC 3 adjusts and outputs a voltage 26 output from the regulator 25. The voltage 26 serves as a reference voltage of the DA converter 24. The IC 3 then sets input data of the DA converter 24, and outputs a non-image luminance correction analog voltage 322, which increases or decreases within a main scan, in synchronization with the BD signal 111. The VI conversion circuit 326 in the subsequent stage converts the non-image luminance correction analog signal 322 into a VI conversion output current value Ie 323, which is output to the laser driver IC 9. In the present exemplary embodiment, the IC 3 installed in the control unit 1 outputs the image luminance correction analog voltage 312 and the non-image luminance correction analog voltage 322. However, DA converters may also be installed on the laser driving circuit 300, and the image luminance correction analog voltage 312 and the non-image luminance correction analog voltage 322 may be generated near the laser driver IC 9.

The laser driver IC 9 operates a switch 14 according to the VDO signal 110 to switch a light emission state of the light source 401 between a normal light emission state for performing normal exposure and a weak light emission state for performing weak exposure. During normal exposure, a laser current value IL (normal light emission current) supplied to the light emission unit 11 is set to a current obtained by subtracting the VI conversion output current value Id (normal light emission subtraction current) output from the VI conversion circuit 306 from a current Ia (normal light emission reference current) set by a constant current circuit 15. During weak exposure, the laser current value IL (weak light emission value) supplied to the light emission unit 111 is set to a current obtained by subtracting the VI conversion output current value Ie 323 (weak light emission subtraction current) output from the VI conversion circuit 326 from a current Ib (weak light emission reference current) set by a constant current circuit 17. The light emission unit 11 is provided with a photodetector 12 which is included in the light source 401 for the purpose of light amount monitoring. The current Ia flowing through the constant current circuit 15 is automatically adjusted by feedback control by internal circuitry of the laser driver IC 9 so that image part luminance detected by the photodetector 12 coincides with a desired luminance Papc1. The current Ib flowing through the constant current circuit 17 is automatically controlled by feedback control by the internal circuitry of the laser driver IC 9 so that non-image part luminance detected by the photodetector 12 coincides with a desired luminance Papc2. The automatic adjustment is automatic power control (APC). The automatic adjustment of the luminance of the light emitting unit 11 is performed while the light emitting unit 11 emits light to detect the BD signal 111 outside a print area (see FIG. 13) of a laser emission amount 316 for each main scan. A method for setting the VI conversion output current value Id 313 output by the VI conversion circuit 306 will be described below. Values of variable resistances 13 and 16 are adjusted at the time of assembling in a factory so that desired voltages are input to the laser driver IC 9 when the light emission unit 11 emits light with respective predetermined luminance.

As described above, a current obtained by subtracting the VI conversion output current value Id 313 output by the VI conversion circuit 306 from the current Ia needed for a desired luminance of light emission is supplied as the laser driving current IL to the light emission unit 11. Such a configuration prevents the laser driving current IL of Ia or more intended for the image part, from flowing to the device. A current obtained by subtracting the VI conversion output current value Ie 323 output by the VI conversion circuit 326 from the current Ib needed for a desired luminance of light emission is supplied as the laser driving current IL to the light emission unit 11. Such a configuration prevents the laser driving current IL of Ib or more intended for the non-image part from flowing to the device. The VI conversion circuits 306 and 326 constitute a part of the luminance correction unit.

Figure 12A:
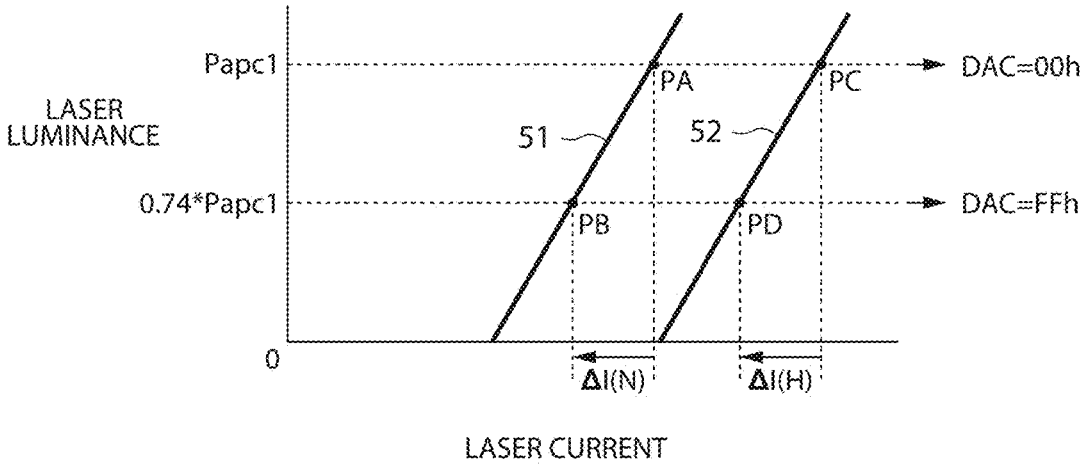
FIG. 12A is a graph illustrating a temperature characteristic of a current and luminance of a light emission unit. FIG.
Figure 12B:
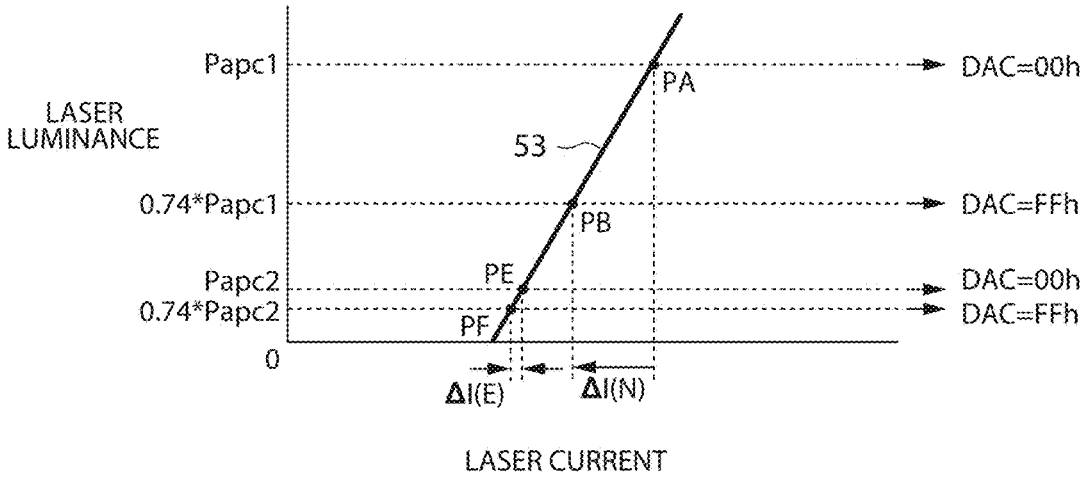

FIGS. 12A and 12B are graphs illustrating a characteristics of the current and luminance of the light emission unit 11. The current Ia needed for the light emission unit 11 to emit light with a predetermined luminance varies according to the ambient temperature. A graph 51 of FIG. 12A illustrates an example of a current-luminance graph under a normal temperature environment. A graph 52 illustrates an example of a current-luminance graph under a high temperature environment. It is known in general that the current Ia of laser diodes needed to output predetermined luminance varies in a case where the ambient temperature changes but its efficiency (gradient in the chart) hardly changes. More specifically, while the current value indicated by the point PA is needed as the current Ia to emit light with the predetermined luminance Papc1 under the normal temperature environment, the current value indicated by the point PC is needed as the current Ia under the high temperature environment. As described above, even if the ambient temperature changes, the laser driver IC 9 monitors the luminance with the photodetector 12 and automatically adjusts the current Ia to be supplied to the light emission unit 11 to provide the predetermined luminance Papc1. Since the efficiency changes little along with the ambient temperature, the luminance can be reduced to 0.74 times the predetermined luminance Papc1 by subtracting a predetermined current ΔI(N) or ΔI(H) from the current Ia for emitting light with the predetermined luminance Papc1. Since the efficiency changes little along with the ambient temperature, the currents ΔI(N) and ΔI(H) approximately shows the same value. In the present exemplary embodiment, the luminance of the light emission unit 11 is gradually increased as the position shifts from the central portion (axial image height) to the ends (outermost off-axis image heights) (as the image height Y increases in absolute value). In the central portion, the light emission unit 11 emits light with the luminance indicated by the point PB or PD in FIG. 12A. At the ends, the light emission unit 11 emits light with the luminance indicated by the point PA or PC.

A graph 53 of FIG. 12B illustrates an example of the current-luminance graph under the normal temperature environment. The point PA indicates the luminance of an image part at the ends (outermost off-axis image heights), and the point PB indicates the luminance (first light emission luminance) of an image part in the central portion (axial image height). If the input value of the DA converter 21 of the control unit 1 is 00h, the luminance at the point PA is Papc1. If the input value is FFh, the luminance at the point PB is 0.74×Papc1. In other words, the first light emission luminance ranges between Papc1 and 0.74×Papc1.

The luminance for exposing a non-image part (second light emission luminance) ranges between points PE and PF which are lower than the luminance for exposing an image part. The point PE indicates the luminance of a non-image part at the ends (outermost off-axis image heights). The point PF indicates the luminance of a non-image part in the central portion (axial image height). In the present exemplary embodiment, if the input value of the DA converter 24 of the control unit 1 is 00h, the luminance at the point PE is Papc2. If the input value is FFh, the luminance at the point PF is 0.74×Papc2. In other words, the second light emission luminance ranges between Papc2 and 0.74×Papc2.

The luminance correction of the image part is performed by subtracting the VI conversion output current value Id 313 corresponding to the predetermined current ΔI(N) or ΔI(H) from the current Ia that is automatically adjusted (APC) to emit light with a desired luminance. Similarly, the luminance correction of the non-image part is performed by subtracting the VI conversion output current value Ie 323 corresponding to ΔI(E) from the current Ib that is automatically adjusted (APC) to emit light with a desired luminance. As described above, the scanning speed increases as the image height Y increases in absolute value. Then, as the image height Y increases in absolute value, the total amount of exposure (integral light amount) of one pixel decreases. In other words, as the image height Y decreases in absolute value, the total amount of exposure (integral light amount) of one pixel increases. Accordingly, the luminance correction is performed so that the luminance decreases along with decrease of the absolute value of the image height Y. Specifically, the VI conversion output current value Id 313 is set to increase as the image height Y decreases in absolute value, so that the laser driving current IL decreases along with decrease of the absolute value of the image height Y. In such a manner, the luminance can be appropriately corrected.

<Description of Operation>

FIG. 13 is a timing chart for describing the partial magnification correction and the luminance correction described above. The memory 304 of FIG. 5 stores the partial magnification characteristic information 317 about the optical scanning unit 400. The partial magnification characteristic information 317 may be measured and stored in each individual optical scanning unit 400 after the optical scanning unit 400 is assembled. If there is not much variation between the optical scanning units 400, representative characteristics may be stored without carrying out individual measurements. The CPU core reads the partial magnification characteristic information 317 from the memory 304 via the serial communication 307, and transmits the partial magnification characteristic information 317 to the CPU 102 in the image signal generation unit 100. Based on the partial magnification characteristic information 317, the CPU core 2 generates and transmits partial magnification correction information 314 to the pixel piece insertion/extraction control unit 128 in the image modulation unit 101 of FIG. 5. In FIG. 13, the change rate C of the scanning speed is 35%. Accordingly, FIG. 13 illustrates an example where a partial magnification of 35% occurs at the outermost off-axis image heights with reference to the axial image height. In the present example, the partial magnification correction information 314 is such that the partial magnification is corrected by −18% (−18/100) at the outermost off-axis image heights and by +17% (+17/100) at the axial image height, with zero correction at points where the partial magnification is 17%. Consequently, as illustrated in the chart, in the areas near the ends in the main scanning direction where the absolute value of the image height Y is large, pixel pieces are extracted to reduce the image length. In the area near the center where the absolute value of the image height Y is small, pixel pieces are inserted to increase the image length. As described with reference to FIGS. 11A and 11B, to make a correction of −18% at the outermost off-axis image heights, 18 pixel pieces are extracted from 100 pixel pieces. To make a correction of +17% at the axial image height, 17 pixel pieces are inserted into 100 pixel pieces. With reference to the vicinity of the axial image height (center), such a state is substantially equivalent to when 35 pixel pieces are extracted from 100 pixels near the outermost off-axis image heights (ends). This allows a correction of 35% to the partial magnification. In other words, in the period in which the spot of the laser light 208 moves over the scanning target surface 407 by width of a pixel (42.3 μm (600 dpi)), the outermost off-axis image heights becomes 0.74 times the axial image height.

The ratio of the scanning period for the width of a pixel at the outermost off-axis image heights to the scanning period for the width at the axial image height can be expressed, by using the change rate C of the scanning speed, as follows:

$$100\ [\%]/(100\ [\%] + C\ [\%]) = 100\ [\%]/(100\ [\%] + 35\ [\%]) = 0.74.$$

Such insertion and extraction of pixel pieces having a width smaller than a pixel can correct the pixel widths to form latent images corresponding to each pixel at substantially equal intervals in the main scanning direction.

Alternatively, the axial image height may be used as a reference and the pixel width in the vicinity of the axial image height may be used as a reference pixel width without performing insertion or extraction of pixel pieces, while the rate of extraction of pixel pieces may be increased as the image height Y approaches the outermost off-axis image heights. In contrast, the outermost off-axis image heights may be used as a reference and the pixel width in the vicinities of the outermost off-axis image heights may be used as a reference pixel width without performing insertion or extraction of pixel pieces, while the rate of insertion of pixel pieces may be increased as the image height Y approaches the axial image height. However, the image quality improves if pixel pieces are inserted and extracted so that pixels at intermediate image heights between the axial image height and the outermost off-axis image heights have a reference pixel width (width as much as 16 pixel pieces). That is, the smaller the absolute values of the differences between the reference pixel width and the pixel widths of the pixels into/from which pixel pieces are inserted or extracted, the more faithful image densities in the main scanning direction are to the original image data, accordingly favorable image quality can be obtained.

In the luminance correction, the CPU core 2 reads the partial magnification characteristic information 317 and correction current information about the image and non-image parts from the memory 304 before a print operation is performed. The partial magnification characteristic information 317 is information about the scanning position of the laser light 208 on the surface of the photosensitive drum 4 and the scanning speed corresponding to the scanning position. The partial magnification characteristic information 317 is information indicating the characteristic of the scanning speed which changes according to a change in the scanning position (scanning speed characteristic information). The correction current information refers to information about the values of the correction currents corresponding to the scanning speed. The CPU core 2 in the IC 3 generates luminance correction values 315 based on the partial magnification characteristic information 317 and the correction current information, and stores the luminance correction values 315 corresponding to one scan into a not-illustrated register in the IC 3. The CPU core 2 further determines the output voltage 23 of the regulator 22 based on the correction current information about the image part, and inputs the output voltage 23 to the DA converter 21 as a reference voltage. The CPU core 2 then reads the luminance correction values 315 stored in the not-illustrated register in synchronization with the BD signal 111. Consequently, the image luminance correction analog voltage 312 is transmitted from the output port of the DA converter 21 to the VI conversion circuit 306 in the subsequent stage, and converted into the VI conversion output current value Id 313. The VI conversion output current value Id 313 is input to the laser driver IC 9 and subtracted from the current Ia. Similarly, the CPU core 2 determines the output voltage 26 of the regulator 25 based on the correction current information about the non-image part, and inputs the output voltage 26 into the DA converter 24 as a reference voltage. The CPU core 2 then reads the luminance reference values 315 stored in the not-illustrated register in synchronization with the BD signal 111. As a result, the non-image luminance correction analog voltage 322 is transmitted from the output port of the DA converter 24 to the VI conversion circuit 326 in the subsequent stage, and converted into the VI conversion output current value Ie 323. The VI conversion output current value Ie 323 is input to the laser driver IC 9 and subtracted from the current Ib.

As illustrated in FIG. 13, the luminance correction values 315 vary according to the irradiation position (image height) of the laser light 208 on the scanning target surface 407. The VI conversion output current value Id 313 and the VI conversion output current value Ie 323 are therefore also changed according to the irradiation position of the laser light 208. In such a manner, the laser driving current IL which passes through the laser diode is controlled.

The luminance correction values 315 generated by the CPU core 2 according to the partial magnification characteristic information 317 and the correction current information are set so that the VI conversion output current value Id 313 and the VI conversion output current value Ie 323 decrease as the image height Y increases in absolute value. As illustrated in FIG. 13, the laser driving current IL therefore increases as the image height Y increases in absolute value. In other words, the VI conversion output current value Id 313 and the VI conversion output current value Ie 323 vary during one scan, and the laser driving current IL decreases near the central portion of the image (as the image height Y decreases in absolute value). Consequently, as illustrated in the chart, the laser light 208 output from the light emission unit 11 is corrected, so that the laser light 208 is emitted with an image part luminance of Papc1 at the outermost off-axis image heights, and with an image part luminance of 0.74 times Papc1 at the axial image height. The laser light 208 is also corrected, so that laser light 208 is emitted with a non-image part luminance of Papc2 at the outermost off-axis image heights, and with a non-image part luminance of 0.74 times Papc2 at the axial image height. In other words, the laser light 208 is attenuated by an attenuation factor of 26%. That is, the luminance at the outermost off-axis image heights is 1.35 times higher than at the axial image height. The attenuation factor R [%] can be expressed, by using the change rate C of the scanning speed, as follows:

$$R = (C/(100 + C)) * 100 = 35\ [\%]/(100\ [\%] + 35\ [\%]) * 100 = 26\ [\%].$$

The input of the DA converter 21 and the rate of decrease of the luminance are proportional to each other. For example, suppose that the light amount is set to decrease by 26% if the input of the DA converter 21 in the CPU core 2 is FFh. In such a case, the light amount decreases by 13% at an input of 80h.

<Description of Effect>

Figure 4A:
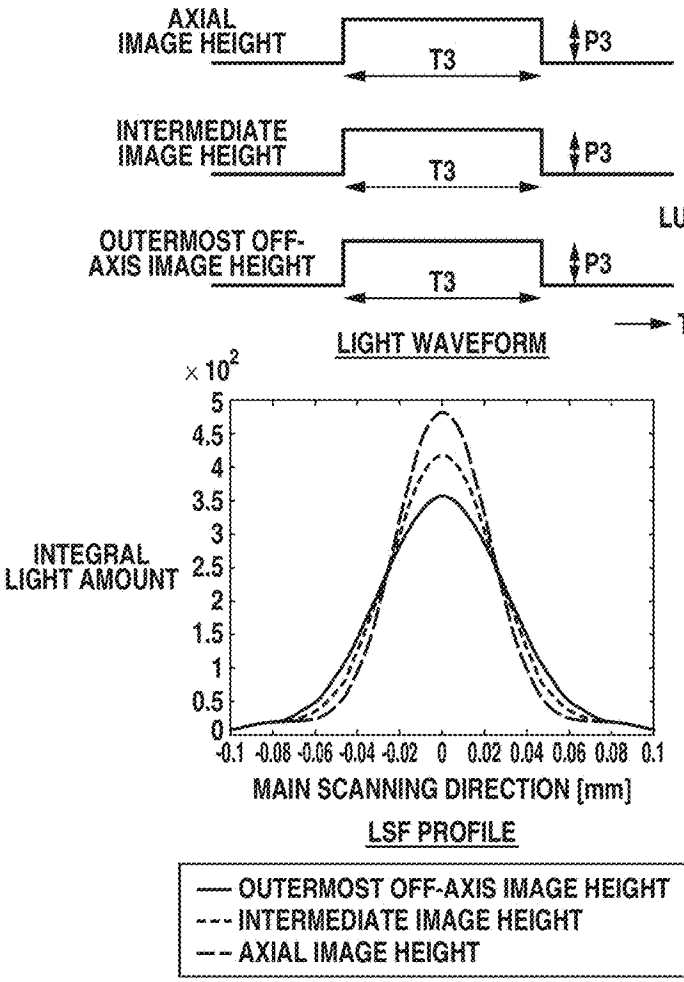
FIG. 4A is a diagram illustrating light waveforms and main scanning line spread function (LSF) profiles of comparative example 1.
Figure 4B:
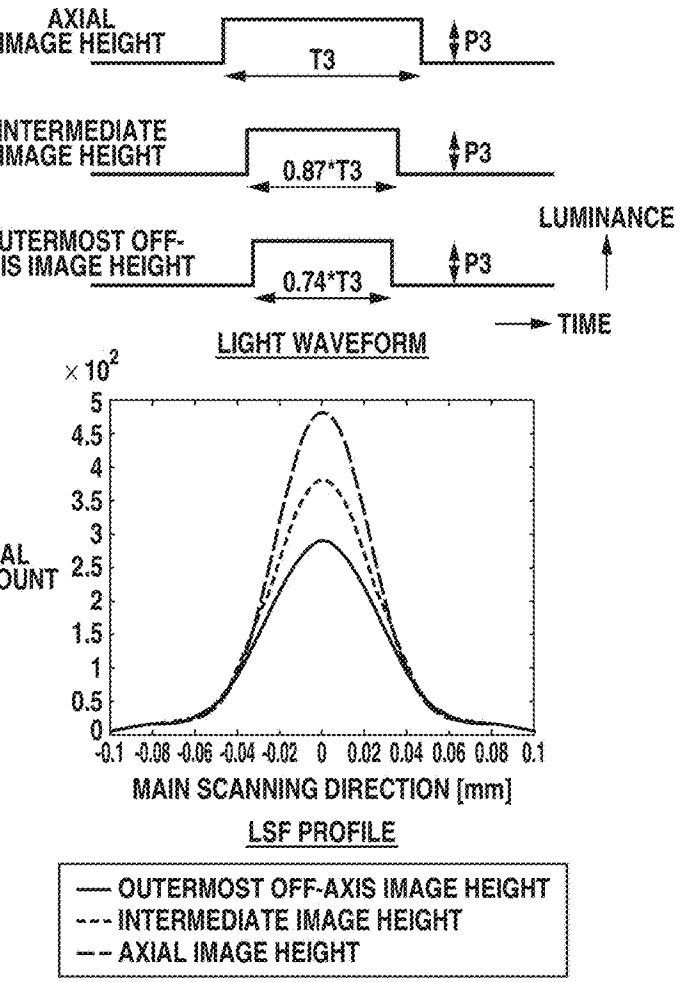
FIG. 4B is a diagram illustrating light waveforms and main scanning LSF profiles of comparative example 2.
Figure 4C:
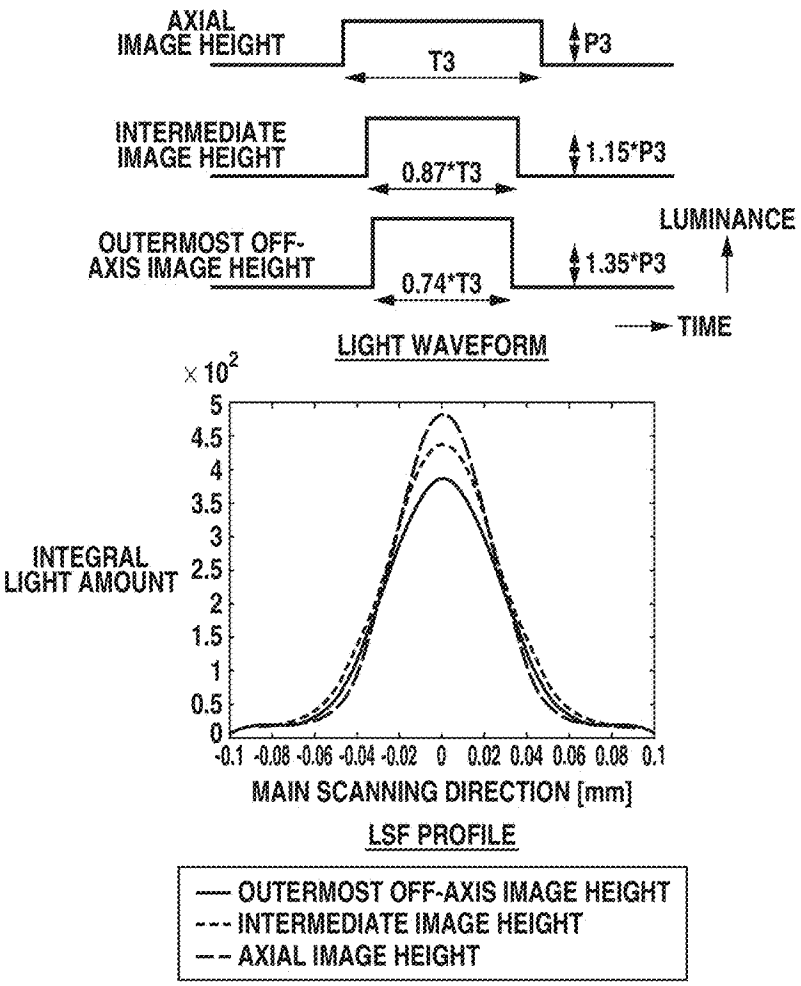
FIG. 4C is a diagram illustrating light waveforms and main scanning LSF profiles of a first exemplary embodiment.

FIGS. 4A to 4C are diagrams illustrating light waveforms and main scanning line spread function (LSF) profiles. The light waveforms and main scanning LSF profiles illustrate each case where a light source 401 emits light with predetermined luminance and for a predetermined period at the axial image height, an intermediate image height, and the outermost off-axis image heights. With the optical configuration according to the present exemplary embodiment, the scanning speed at the outermost off-axis image heights is 135% of the speed at the axial image height. The partial magnification at the outermost off-axis image heights is 35% with respect to the axial image height. The light waveform is a waveform of the light source 401. The main scanning LSF profiles are obtained when integrating a spot profile formed on the scanning target surface 407 in the sub scanning direction by emitting the foregoing light waveform while moving the spot in the main scanning direction. The main scanning LSF profiles indicate the total amounts of exposure (integral light amounts) on the scanning target surface 407 when the light source 401 emits light with the foregoing light waveform.

FIG. 4A illustrates comparative example 1 with the same optical configuration as that of the present exemplary embodiment, where neither the foregoing partial magnification correction nor luminance correction is performed. In this comparative example 1, the light source 401 emits light with a luminance of P3 and for a period T3 that is needed to perform a main scan as much as one pixel (42.3 μm) at the axial image height. It can be seen that the main scanning LSF profile spreads and the peak of the integral light amount lowers as the image height Y shifts from the axial image height to off-axis image heights.

FIG. 4B illustrates comparative example 2, where the foregoing partial magnification correction is performed but the luminance correction is not performed. The partial magnification correction is performed by reducing the period corresponding to one pixel according to an increase in the partial magnification as the image height Y shifts from the axial image height to off-axis image heights, with reference to the period T3 required to perform a main scan of one pixel (42.3 μm) at the axial image height. The luminance is kept constant at P3. The spreading of the main scanning LSF profile is suppressed as the image height Y shifts from the axial image height to off-axis image heights. However, since the irradiation time decreases to 0.87 times T3 at the intermediate image height, and 0.74 times T3 at the outermost off-axis image heights, it can be seen that the peak of the integral light amount lowers further as compared to FIG. 4A.

FIG. 4C illustrates the present exemplary embodiment where the foregoing partial magnification correction and luminance correction are performed. With respect to the partial magnification correction, the same processing as comparative example 2 is performed. The integral light amount decreases due to the reduction of the light emission time of the light source 401 in lighting one pixel as a result of the partial magnification correction as the image height Y shifts from the axial image height to off-axis image heights. Accordingly, the decreased integral light amount is compensated by the luminance correction. In other words, the luminance of the light source 401 is corrected to increase with reference to the luminance P3 as the image height Y shifts from the axial image height to off-axis image heights. In FIG. 4C, the luminance at the outermost off-axis image heights is 1.35 times P3. As compared to FIG. 4B, as the image height Y shifts from the axial image height to off-axis image heights, the decrease in the peak of the integral light amount of the main scanning LSF profile is suppressed and the spreading is suppressed as well. Although the LSF profiles at the axial image height, the intermediate image height, and the outermost off-axis image heights in FIG. 4C do not perfectly coincide with each other, the total amounts of exposure of the pixels are approximately the same and are successfully corrected to a level which does not affect the formed image.

As described above, according to the present exemplary embodiment, the image forming apparatus that makes a weak exposure on a non-image part, performs the partial magnification correction, the luminance correction of an image part, and the luminance correction of the non-image part. As a result, the image forming apparatus can appropriately expose the non-image part to suppress image defects without using a scanning lens having an fθ characteristic. Further, the partial magnification correction values, the luminance correction values of the image part, and the luminance correction values of the non-image part can be generated from the partial magnification characteristic information 317 (or characteristic information about the scanning speed on the photosensitive drum 4) for generating the luminance correction values of the image part and the information about the correction currents. This can reduce the storage capacity of the storage unit such as the memory 304.

In the present exemplary embodiment, the partial magnification correction is performed by the insertion and extraction of pixel pieces. Correcting the partial magnification by such a method has the following effect as compared to the foregoing other methods where the frequency of the image clock is changed in the main scanning direction. That is, in the case of changing the frequency of the image clock in the main scanning direction, clock generation units capable of outputting image clocks having a plurality of different frequencies are required. This means that cost increases due to such clock generation units. In contrast, the partial magnification correction by the insertion and extraction of pixel pieces can be performed with only one clock generation unit. The cost related to the clock generation unit can thus be suppressed.

A second exemplary embodiment will be described below. To realize an inexpensive configuration, according to the present exemplary embodiment, of the fθ correction, the total exposure amount correction is performed through density correction without performing luminance correction during main scanning writing. Further, the weak exposure of the non-image part is also performed through density correction. In other words, in the present exemplary embodiment, correction corresponding to the luminance correction for the weak exposure of the non-image part according to the first exemplary embodiment is performed through density correction by changing the turn-on ratio of the light source 401.

<Exposure Control Configuration>

FIG. 14 is a diagram illustrating an exposure control configuration according to the present exemplary embodiment. FIG. 14 illustrates a typical configuration obtained by omitting the variable current circuits for correcting luminance (the calculation of the correction values in the CPU core 2 of the control unit 1, and the VI conversion circuits 306 and 326), from the configuration of the first exemplary embodiment illustrated in FIG. 5. A laser driver IC 19 is an example of the luminance control unit. The laser driver IC 19 performs one line of scan in the print area by emitting light with an identical luminance, and performs APC control outside the print area (=between lines). The density correction control unit 121 (FIG. 7) in the image modulation unit 101 of the image signal generation unit 100 performs density correction control according to the present exemplary embodiment. Since the rest of the configuration is similar to that of the first exemplary embodiment, the similar reference numerals are assigned thereto and a description thereof will be omitted. Since the partial magnification correction is similar to that of the first exemplary embodiment, a description thereof will be also omitted.

<Overview of Density Correction>

An overview of the density correction according to the present exemplary embodiment will be described. Typical density correction is performed by gradation correction for uniformizing linearity of density control values and actual print densities. Although a description has been omitted, the density correction processing unit 121 according to the first exemplary embodiment also performs gradation correction. The density correction processing unit 121 according to the present exemplary embodiment simultaneously performs three types of density corrections. The three types of density corrections will be described below with reference to FIGS. 15A to 15D.

A first density correction is a density correction for performing typical gradation correction. The correction details can be expressed as an input/output function illustrated by a graph 61 of FIG. 15A. A second density correction is a density correction for making a weak exposure of a non-image part. This density correction corresponds to a first light emission amount control unit and a second light emission amount control unit. The correction details can be expressed as an input/output function illustrated by a graph 62 of FIG. 15B. Its specifics will be described below. A third density correction is a density correction for performing fθ correction about the total amount of exposure. This density correction corresponds to a first light emission amount correction unit and a second light emission amount correction unit. The correction details can be expressed as an input/output function illustrated by a graph 63 of FIG. 15C. The graph 63 indicates that the density correction is performed according to respective image heights. Its specifics will be described below. A graph 64 of FIG. 15D illustrates an input/output function related to the density corrections obtained by combining the graphs 61, 62, and 63. This input/output function is applied to the density correction by the density correction processing unit 121 according to the present exemplary embodiment.

<Gradation Correction>

Next, the gradation correction will be described with reference to FIGS. 16A to 16C. FIG. 16A is a diagram illustrating an example of density gradations before the gradation correction is performed. FIG. 16A illustrates a relationship between a light amount control value indicated on the horizontal axis and an actual print density indicated on the vertical axis. The gradation correction refers to performing density correction as shown in a graph 71 that traces a straight line. FIG. 16B illustrates a density correction function for performing the gradation correction on the graph 71. The density correction function for performing the gradation correction is given by the graph 61 which is shaped like a mirror image of the corrected straight line indicated by the broken line. A graph 72 of FIG. 16C illustrates the result of performing density correction processing using the graph 61 on the graph 71. The graph 72 shows that the light amount control value and the actual print density are proportional to each other. In such a manner, the gradation correction can be achieved by the density correction processing of the graph 61 of FIG. 16B or 15A.

<Weak Exposure of Non-Image Part by Density Correction>

Next, a density correction for performing weak exposure of the non-image part with a density of 10% will be described with reference to FIGS. 15B and 17. Note that the density of the non-image part, 10%, is an example. On the graph 62 of FIG. 15B, the output value for an input value 00h of the non-image part is 19h (=10% of FFh). The graph 62 shows that the remaining 90% of the exposure amount is uniformly distributed between 20h and FFh. As a result, the densities of 0% to 100% are controlled by the light amount control values of 19h to FFh.

FIGS. 17A to 17J are timing charts for describing the partial magnification correction and the density correction. The partial magnification correction part is similar to that of FIG. 13 described above. A description thereof will thus be omitted. The present exemplary embodiment is configured to control the luminance to have a constant level. Unlike the first exemplary embodiment, as illustrated in FIG. 17E, the laser light 208 at the density of 100% is therefore controlled to remain constant during a scan.

Next, in FIG. 17F, the light control values after the gradation correction are constant in the main scanning direction, 00h for a density of 0%, 7Fh for a density of 50%, and FFh for a density of 100%. The density correction processing performed by the graph 62 of FIG. 15B converts the light amount control values, as illustrated in FIG. 17G, into 19h for a density of 0%, 8Ch for a density of 50%, and FFh for a density of 100%. The densities are constant in the main scanning direction. In such a manner, the density correction processing by the graph 62 of FIG. 15B can achieve the weak exposure.

<fθ Correction by Density Correction>

Next, the density correction for correcting the amount of exposure according to the image height will be described with reference to FIGS. 15C and 17A-17J. The fθ characteristic is such that the scanning speed is the lowest at the center image height, and the scanning speed increases as the image height increases. The amount of exposure is thus the largest at the center image height, and the amount of exposure decreases as the image height increases. The fθ correction is thus performed so that the amount of exposure becomes the largest at the outermost off-axis image height, and the amount of exposure decreases as the image height decreases.

The graph 63 of FIG. 15C includes a plurality of graphs using the image height as a parameter. Of these, the graph of the outermost off-axis image height provides the highest output values. In other words, the amount of exposure is the largest at the outermost off-axis image height. The output values in the graph of the center image height are 74% of the output values in the graph of the outermost off-axis image height. The density correction is thus performed so that the density (graph point G) of a black 100% image at the center image height and the 74% halftone density (graph point H) at the outermost off-axis image height have the same output value of BDh.

The density correction processing by the graph 63 can thus achieve the fθ correction.

A case will be described with reference to FIGS. 17A-17J where the density correction processing by the graph 63 of FIG. 15C is performed after the density correction processing by the graph 62 of FIG. 15B is performed. FIG. 17G shows the light amount control values after the non-image part weak exposure correction. If the fθ correction is applied to FIG. 17G, as illustrated in FIG. 17H, images having a density of 0%, 50%, and 100% are each fθ-corrected and converted into data in which the density at the outermost off-axis image height is the highest and the density gradually decreases from the outermost off-axis image height to the lowest density at the center image height. In such a manner, in the non-image part, the density is lower, the turn-on ratio of the light source is lower, and the amount of exposure is smaller at the center image height where the scanning speed is low than at the outermost off-axis image heights where the scanning speed is high. The same holds for the image part.

The total amount of exposure per unit area of the photosensitive drum 4, which is determined by the luminance in FIG. 17E and the density in FIG. 17H, is thus shown in FIG. 17I. The total amount of exposure is such that the density at the outermost off-axis image height is the highest, and the density gradually decreases and becomes 74% of the outermost off-axis image height, at the center image height. As illustrated in FIG. 17J, the total amount of exposure is thus constant across all the image heights.

The light amount of a density of 100% changes in the range of BDh to FFh, and can thus be controlled in 255−189=66 steps. On the other hand, the light amount of the non-image part changes in the range of 12h to 19h, and can thus be controlled in only 25−18=7 steps. If the light amount of the non-image part is to be controlled at the same rate (number of steps) as that of the image part, the light amount control values need to be increased from the 256 bit control to 512 bit control or more.

However, the non-image part only needs to control the potential of the photosensitive drum 4 such that abnormal adhesion (fogging) of toner will not occur. In other words, the non-image part only needs to be weakly exposed such that the back contrast Vback can be reduced to below a predetermined value. The back contrast Vback can thus be limited to within a desired range without setting the potential as precisely as in the case of the image part. The light amount of the non-image part can thus achieve sufficient precision without taking the same number of control steps as the image part.

<Density Correction>

Next, the density correction of the present exemplary embodiment will be specifically described with reference to FIGS. 14, 15D, 18A, and 18B. The memory 304 of FIG. 14 stores the partial magnification characteristic information 317 about the optical scanning unit 400. The partial magnification characteristic information 317 may be measured and stored in each individual optical scanning unit 400 after the optical scanning unit 400 is assembled. Alternatively, if there is not much variation among the optical scanning units 400, representative characteristics may be stored without individual measurements. The CPU core 2 reads the partial magnification characteristic information 317 from the memory 304 via the serial communication 307, and transmits the partial magnification characteristic information 317 to the CPU 102 in the image signal generation unit 100. Based on the partial magnification characteristic information 317, the CPU core 2 generates the input/output function of the relationship in the graph 64, and transmits the input/output function to the density correction processing unit 121 in the image modulation unit 101.

Meanwhile, image data (P) illustrated as an example in FIG. 18A is input from a not-illustrated host computer to the density correction processing unit 121. The density correction processing unit 121 performs density conversion by using different graphs 64 according to the image height, and outputs converted image data (converted P) illustrated in FIG. 18B. Specifically, pixels 150 having an input value of F0h are converted into pixels 250 having an output value of CBh and pixels 251 having an output value of B5h. Pixels 151 having an input value of 80h are converted into pixels 252 having an output value of 64h and pixels 253 having an output value of 5Ch. Pixels 152 having an input value of 60h are converted into a pixel 254 having an output value of 56h, pixels 255 having an output value of 4Dh, and pixels 256 having an output value of 47h. Pixels having an input value of 00h corresponding to the non-image part are converted into pixels 257 having an output value of 19h, pixels 258 having an output value of 17h, pixels 259 having an output value of 14h, and pixels 260 having an output value of 13h. In such processing, the correction of the amount of exposure can be performed according to the image height through density correction.

The image modulation unit 101 converts the converted image data (converted P) output from the density correction processing unit 121 into a VOD signal 110 for lighting each pixel of the image data at a predetermined turn-on ratio according to the output value. The light source 410 emits light based on the VDO signal 110 to emit light at the turn-on ratio set for each pixel of the converted image data (converted P).

As described above, according to the present exemplary embodiment, the image forming apparatus that performs weak exposure on a non-image part performs the partial magnification correction, the luminance correction of an image part, and the luminance correction of the non-image part. As a result, the image forming apparatus can appropriately expose the non-image part to suppress image defects without using a scanning lens having an fθ characteristic.

Further, when the density correction values of both the image part and the non-image part are generated from the same partial magnification characteristic information 317 (or the characteristic information about the scanning speed on the photosensitive drum 4), the precision (number of steps) of the light amount control may be changed between the image part and the non-image part. Specifically, the precision of exposure amount control on the non-image part can be lowered (the number of steps is reduced) to provide an inexpensive configuration.

In the present exemplary embodiment, the memory 304 storing the partial magnification characteristic information 317 is installed in the optical scanning unit 400. However, if there is not much variation between the optical scanning units 400, the memory 304 may be installed in the image signal generation unit 100 or the control unit 1.

A third exemplary embodiment will be described below. The present exemplary embodiment deals with another exemplary embodiment which does not perform luminance correction during a main scanning writing. According to the present exemplary embodiment, of the fθ corrections, the total exposure amount correction and the weak exposure of the non-image part through density correction are performed like the second exemplary embodiment. A difference from the second exemplary embodiment lies in that the foregoing two types of corrections are not incorporated into the density correction processing unit 121 but into the halftone correction unit 122 which performs matrix conversion.

<Exposure Correction Configuration>

FIG. 19 is a diagram illustrating an exposure correction configuration according to the present exemplary embodiment. The present exemplary embodiment differs from the second exemplary embodiment in the configuration of an image modulation unit 161 of the image signal control unit 100 illustrated in FIG. 19. Since the rest of the configuration is similar to that of the second exemplary embodiment, the same reference numerals are assigned thereto and a description thereof will be omitted. Since the partial magnification correction is similar to that of the second exemplary embodiment, a description thereof will be omitted.

<Density Correction>

The total exposure amount correction for correcting the fθ characteristic and the weak exposure of the non-image part are performed by a halftone processing unit 186 of the image modulation unit 161 illustrated in FIG. 20. The halftone processing unit 186 stores screens corresponding to respective image heights. The halftone processing unit 186 selects a screen based on information output from a screen (SCR) switching unit 185, and performs halftone processing. The SCR switching unit 185 generates screen switching information 184 from the BD signal 111, which is a synchronization signal, and the image clock signal 125. FIG. 21 is a diagram for describing screens corresponding to respective image heights. The SCR switching unit 185 outputs the screen switching information 184 as illustrated in the diagram according to the image height in the main scanning direction. The screen switching information 184 includes a first screen SCR1 at the outermost off-axis image heights, and an nth screen SCRn at the axial image height. The halftone processing unit 186 and the SCR switching unit 185 function as the first light emission amount control unit, the second light emission amount control unit, the first light emission amount correction unit, and the second light emission amount correction unit.

First screens 500 to 510 are examples of the screen used near the outermost off-axis image height. nth screens 540 to 550 are examples of the screen used near the center image height. (n÷2)th screens 520 to 530 are screens used at an image height in an intermediate position between the outermost off-axis image height and the central image height. The screens are 200-line matrixes and can express gradations with 16 pixel pieces into which each pixel is divided. The screens are configured such that each screen including nine pixels grows in an area (increases in the turn-on ratio) corresponding to density information expressed by multivalued parallel 8-bit data of the VDO signal 110. The screens are provided for each gradation (density). The gradation ascends (the turn-on ratio increases and the density increases) in the order illustrated by the arrows. As illustrated in the diagram, the nth screen is set such that all the 16 pixel pieces of the pixels are not lighted even in the screen 550 of the highest gradation (maximum density). The screens 500, 520, and 540 are screens for a non-image part. The screen 501 to 510, 521 to 530, and 541 to 550 are screens for an image part.

As described above, according to the present exemplary embodiment, the image forming apparatus that performs the weak exposure on a non-image part performs the partial magnification correction, the luminance correction of an image part, and the luminance correction of the non-image part. As a result, the image forming apparatus can appropriately expose the non-image part to suppress image defects without using a scanning lens having an fθ characteristic.

A fourth exemplary embodiment will be described below. According to the present exemplary embodiment, of the fθ correction, an image forming apparatus 30 uses luminance correction for the total exposure amount correction, and uses density correction for the weak exposure of a non-image part.

<Exposure Control Configuration>

FIG. 22 is a diagram illustrating an exposure control configuration according to the present exemplary embodiment. FIG. 22 illustrates a configuration omitting the variable current circuits for correcting non-image luminance (the regulator 25 and the 8-bit DA converter 24 built in the IC 3 of the control unit 1, and the VI conversion circuit 306) from the configuration of the first exemplary embodiment illustrated in FIG. 5. A luminance correction unit 43 therefore includes an IC 3 including the CPU core 2, one 8-bit DA converter 21, and one regulator 22, and a laser driving unit 300. The laser driving unit 300 includes a laser driver IC 29 which is an example of the luminance control unit. The luminance correction unit 43 is connected to the laser driver IC 29. The luminance correction unit 43 supplies correction information to the laser driver IC 29. The image modulation unit 101 of the image signal generation unit 100 is similar to that of FIG. 7. Since the rest of the configuration is similar to the first exemplary embodiment, the same reference numerals are assigned thereto and a description thereof will be omitted. Since the partial magnification correction is similar to the first exemplary embodiment, a description thereof will be omitted.

<Density Correction>

Next, density correction for performing the weak exposure of the non-image part with 10% of the total amount of exposure will be described with reference to FIGS. 7, 15A to 15D, and 23 to 25B. In the present exemplary embodiment, like the second exemplary embodiment, the density correction processing unit 121 of FIG. 7 performs density correction as a light emission amount correction unit. A difference from the second exemplary embodiment lies in the density correction function (graph). The density correction function (graph) according to the present exemplary embodiment uses an input/output function obtained by combining the graph 61 of FIG. 15A and the graph 62 of FIG. 15B described above. FIG. 15A illustrates the input/output function for correcting gradations. FIG. 15B illustrates the input/output function for converting the amount of exposure so that the non-image part is weakly exposed. The function obtained by combining these input/output functions is expressed as a graph 65 in FIG. 23.

FIG. 24 are a timing chart for describing the foregoing density correction, luminance correction, and partial magnification correction. Since the partial magnification correction part is similar to that of FIG. 13 described above, a description thereof will be omitted. FIG. 24F illustrates an image density distribution in the main scanning direction when only the gradation correction, which is typical density correction, is performed. In other words, FIG. 24F illustrates the image density distribution in the main scanning direction when only the gradation correction (=graph 61) is applied, of the density corrections performed in the graph 65.

Figure 24A:
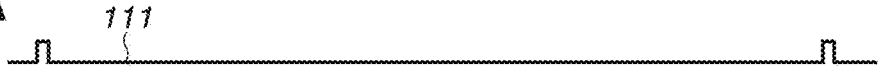
Figure 24B:
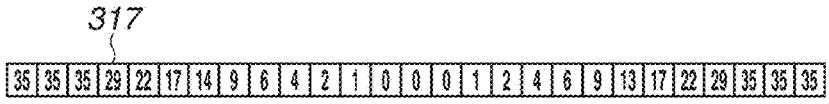
Figure 24C:
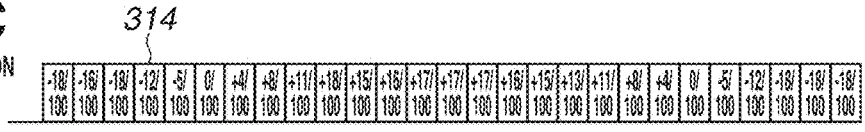
Figure 24D:
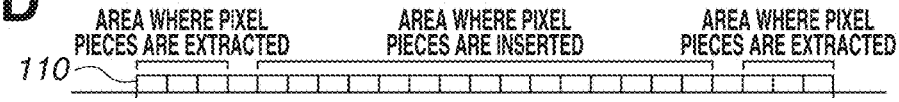
Figure 24E:
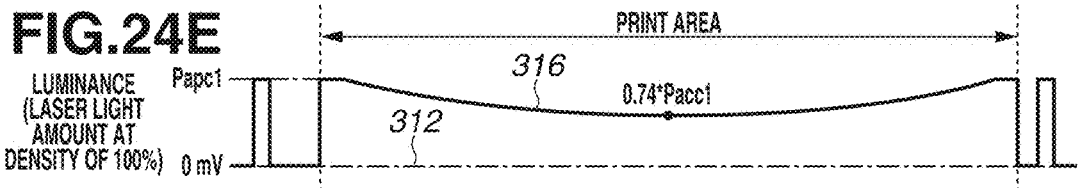
Figure 24F:
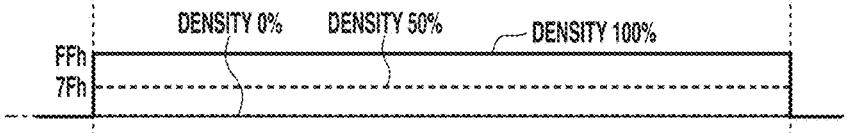
Figure 24G:
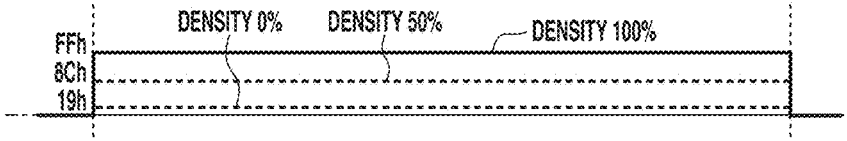

FIG. 24G illustrates an image density distribution in the main scanning direction when the density correction processing unit 121 performs the density correction of the graph 65. A light amount control value at a density of 0% is 19h. 19h is 10% of the maximum value FFh of the light amount control value.

FIG. 25A illustrates an example of a multivalued parallel 8-bit image signal. Each pixel has 8-bit density information. Pixels 150 indicate density information of F0h, pixels 151 density information of 80h, pixels 152 density information of 60h, and white background portions density information of 00h. If the density correction is performed in FIG. 25A by using the function graph 62 of FIG. 15B, an image illustrated in FIG. 25B is obtained. In FIG. 25B, pixels 453 of the non-image part are corrected to 19h. The image part is corrected to increase in density, except a portion of a 100% density. The multivalued parallel 8-bit image signal illustrated in FIG. 25B is the output of the density correction processing 121 of FIG. 7. The image signal is then subjected to the processing in the halftone processing unit 122 and the subsequent processing.

<Luminance Correction>

Next, luminance correction will be described with reference to FIGS. 22 and 24. In FIG. 22, for luminance correction, the CPU core 2 reads the partial magnification characteristic information 307 and correction current information in the memory 304 before a print operation. The CPU core 2 in the IC 3 generates a luminance correction value 315, and stores the luminance correction value 315 for one scan into a not-illustrated register in the IC 3. The CPU core 2 also determines the output voltage 23 of the regulator 22 based on the correction current information, and inputs the output voltage 23 into the DA converter 21 as a reference voltage. The DA converter 21 then reads the luminance correction value 315 stored in the not-illustrated register in synchronization with the BD signal 111. Thus, the image luminance correction analog voltage 312 is transmitted from the output port of the DA converter 21 to the VI conversion circuit 306 in the subsequent stage, and converted into a VI conversion output current value Id 313.

The laser driver IC 29 serving as the luminance control unit controls ON/OFF of the light emission of the light source 401 by switching the laser driving current IL between passing through the light emission unit 11 and passing through a dummy resistance 10, according to the VDO signal 110. The laser current value IL (third current) supplied to the light emission unit 11 is obtained by subtracting the VI conversion output current value Id 313 (second current) from the current Ia (first current) set by the constant current circuit 15.

The VI conversion output voltage value Id 313 varies during one scan, and the laser driving current IL decreases up to the central portion of the image as the image height Y decreases in absolute value. Consequently, as illustrated in FIG. 24E, the laser light 208 output from the light emission unit 11 is corrected to be emitted with a luminance of Papc1 at the outermost off-axis image heights, and with a luminance of 0.74 times Papc1 at the axial image height.

<Laser Light Amount Control>

Figure 24H:
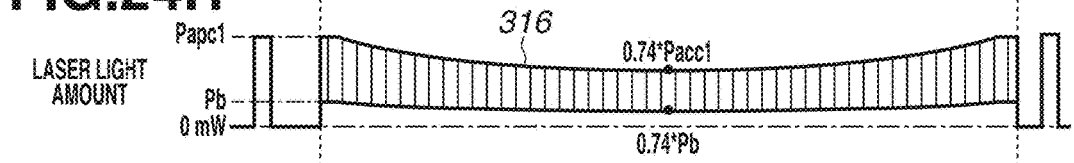

As a result of the weak exposure control on the non-image part through the density correction and the fθ correction through the luminance correction, the laser light 208 during one scan is controlled as illustrated in FIG. 24H. For the image part, the laser light 208 is emitted with a luminance of Papc1 at the outermost off-axis image heights, and with a luminance of 0.74 times as high as Papc1 at the axial image height. The non-image part is lighted with a luminance of Pb at the outermost off-axis image heights, and with a luminance of 0.74 times Pb at the axial image height. In the present exemplary embodiment, Pb is designed to be 0.1 times Papc1.

Figure 24I:
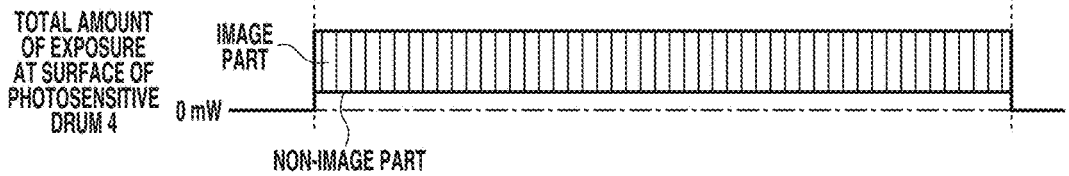

The total amount of exposure on the scanning target surface 407 (=the surface of the photosensitive drum 4) after the laser light 208 illustrated in FIG. 24H passes through the deflector 405 and the imaging lens 406, is constant at all the image heights as illustrated in FIG. 24I. The methods for density correction may be switched according to the type of the image to be printed. For example, in a case of a normal image, the weak exposure of the non-image part may be performed in the density correction processing unit 121 as in the fourth exemplary embodiment. In a case of an image including a lot of thin lines, the weak exposure of the non-image part may be performed in the halftone processing unit 122.

As described above, according to the present exemplary embodiment, the image forming apparatus that performs weak exposure on a non-image part performs the partial magnification correction, the luminance correction of an image part, and the luminance correction of the non-image part. Thus, the image forming apparatus can appropriately expose the non-image part to suppress image defects without using a scanning lens having an fθ characteristic.

The exemplary embodiments of the disclosure have been described in detail above. However, the disclosure is not limited to the foregoing specific exemplary embodiments. For example, the weak exposure of the non-image part may be performed by emitting light with a low luminance dedicated to the non-image part while the fθ correction is carried out by changing the amount of light emission per unit time according to the scanning speed through density correction. Alternatively, the weak exposure and the fθ correction may be performed by controlling both the luminance and density to change the amount of light emission.

According to an exemplary embodiment, a configuration for performing appropriate weak exposure on a non-image part without using a scanning lens having an fθ characteristic can be provided.

While the disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2015-031051, filed Feb. 19, 2015, which is hereby incorporated by reference herein in its entirety.

What is claimed is:

1. An image forming apparatus including a photosensitive member irradiated based on image data by a light source configured to emit laser light, and a deflector configured to deflect the laser light so that the laser light moves over a surface of the photosensitive member in a main scanning direction, wherein a scanning speed at which the laser light moves over the surface of the photosensitive member in the main scanning direction is not constant, the image forming apparatus comprising:

a pixel distance corrector configured to correct a pixel distance in the main scanning direction so that latent images corresponding to each pixel of the image data are formed on the surface of the photosensitive member at substantially equal intervals in the main scanning direction; and a controller configured to control the light source emit laser light with a first light emission luminance with respect to an image part of the photosensitive member, and a second light emission luminance which is lower than the first light emission luminance, with respect to a non-image part of the photosensitive member, wherein the controller is configured to correct light emission luminance so that the second light emission luminance decreases as the scanning speed decreases.

2. The image forming apparatus according to claim 1, wherein the controller is configured to correct the light emission luminance so that the first light emission luminance decreases as the scanning speed decreases.

3. The image forming apparatus according to claim 2, further comprising a storage device, wherein the storage device is configured to store a scanning position of the laser light on the surface of the photosensitive member and a value of the scanning speed corresponding to the scanning position as information about a characteristic of the scanning speed, and wherein the controller is configured to correct the first light emission luminance and the second light emission luminance based on the information about the characteristic of the scanning speed stored in the storage device.

4. The image forming apparatus according to claim 1, wherein the controller is configured to correct the light emission luminance by reducing a current value supplied to the light source as the scanning speed decreases.

5. The image forming apparatus according to claim 1, wherein the light source is configured to emit light according to a light emission signal based on the image data, and wherein the pixel distance corrector is configured to generate the light emission signal corresponding to the image data into/from which a pixel piece having a length smaller than a pixel of the image data in the main scanning direction is inserted or extracted.

6. The image forming apparatus according to claim 1, wherein the light source is configured to emit light according to a light emission signal based on the image data, and wherein the pixel distance corrector is configured to control a frequency of a clock for synchronizing the light emission signal.

7. An image forming apparatus including a photosensitive member, a light source configured to emit laser light to irradiate the photosensitive member, and a deflector configured to deflect the laser light so that the laser light moves over a surface of the photosensitive member in a main scanning direction, wherein a scanning speed at which the laser light moves over the surface of the photosensitive member in the main scanning direction is not constant, the image forming apparatus comprising:

a pixel distance corrector configured to correct a pixel distance in the main scanning direction so that latent images corresponding to each pixel of image data are formed on the surface of the photosensitive member at substantially equal intervals in the main scanning direction; and a controller configured to control the light source emit pulsed light at a light turn-on ratio based on the image data, control the light source emit light at a light turn-on ratio corresponding to a first amount of exposure and expose an image part of the photosensitive member, and control the light source emit light at a light turn-on ratio corresponding to a second amount of exposure which is smaller than the first amount of exposure and expose a non-image part of the photosensitive member, wherein the controller is configured to change the light turn-on ratio so that the second amount of exposure decreases as the scanning speed decreases.

8. The image forming apparatus according to claim 7, wherein the controller is configured to make the light source emit light based on a screen provided corresponding to each gradation, the screen being an assembly of a plurality of pixels, and change the gradation of the screen corresponding to the second amount of exposure so that the second amount of exposure decreases as the scanning speed decreases.

9. The image forming apparatus according to claim 7, wherein the light source is configured to emit light according to a light emission signal based on the image data, and wherein the pixel distance corrector is configured to generate the light emission signal corresponding to the image data into/from which a pixel piece having a length smaller than a pixel of the image data in the main scanning direction is inserted or extracted.

10. The image forming apparatus according to claim 7, wherein the light source is configured to emit light according to a light emission signal based on the image data, and wherein the pixel distance corrector is configured to control a frequency of a clock for synchronizing the light emission signal.

11. An image forming apparatus including a photosensitive member, a light source configured to emit laser light to irradiate the photosensitive member based on image data, and a deflector configured to defect the laser light so that the laser light moves over a surface of the photosensitive member in a main scanning direction, wherein a scanning speed at which the laser light moves over the surface of the photosensitive member in the main scanning direction is not constant, the image forming apparatus comprising:

a pixel distance corrector configured to correct a pixel distance in the main scanning direction so that latent images corresponding to each pixel of the image data are formed on the surface of the photosensitive member at substantially equal intervals in the main scanning direction;

a controller configured to control the light source emit pulsed light at a light turn-on ratio based on the image data, control the light source emit light at a light turn-on ratio corresponding to a first amount of exposure and expose an image part of the photosensitive member, and control the light source emit light at a light turn-on ratio corresponding to a second amount of exposure which is smaller than the first amount of exposure and expose a non-image part of the photosensitive member; and a luminance corrector configured to change light emission luminance of the light source so that the light emission luminance decreases as the scanning speed decreases.

12. The image forming apparatus according to claim 11, wherein the luminance corrector is configured to change the light emission luminance by reducing a current value supplied to the light source as the scanning speed decreases.

13. The image forming apparatus according to claim 11, wherein the light source is configured to emit light according to a light emission signal based on the image data, and wherein the pixel distance corrector is configured to generate the light emission signal corresponding to the image data into/from which a pixel piece having a length smaller than a pixel of the image data in the main scanning direction is inserted or extracted.

14. The image forming apparatus according to claim 11, wherein the light source is configured to emit light according to a light emission signal based on the image data, and wherein the pixel distance corrector is configured to control a frequency of a clock for synchronizing the light emission signal.

* * * * *